US011725467B2

(12) United States Patent
Hradecky et al.

(10) Patent No.: US 11,725,467 B2
(45) **Date of Patent: *Aug. 15, 2023**

(54) TOOL STRING ORIENTATION

(71) Applicant: Impact Selector International, LLC, Heath, TX (US)

(72) Inventors: Jason Allen Hradecky, Heath, TX (US); John Edward Saville, Denton, TX (US)

(73) Assignee: IMPACT SELECTOR INTERNATIONAL, LLC, Heath, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/249,697

(22) Filed: Mar. 10, 2021

(65) Prior Publication Data

US 2022/0412173 A1 Dec. 29, 2022

Related U.S. Application Data

(63) Continuation of application No. 15/574,633, filed as application No. PCT/US2016/037615 on Jun. 15, 2016, now Pat. No. 10,954,726.

(60) Provisional application No. 62/196,229, filed on Jul. 23, 2015.

(51) Int. Cl.
*E21B 17/10* (2006.01)

(52) U.S. Cl.
CPC ..... *E21B 17/1057* (2013.01)

(58) Field of Classification Search
CPC ..... E21B 17/1057; E21B 47/01
See application file for complete search history.

(56) References Cited

U.S. PATENT DOCUMENTS

| | | | |
|---|---|---|---|
| 1,517,027 | A | 11/1924 | Smith |
| 4,415,030 | A | 11/1983 | Walkow |
| 9,200,487 | B2 | 12/2015 | Draper |
| 9,790,748 | B2 | 10/2017 | Hradecky |
| 9,863,198 | B2 | 1/2018 | McCormick |
| 10,364,627 | B2 | 7/2019 | McCormick |
| 10,612,333 | B2 | 4/2020 | McCormick |

(Continued)

FOREIGN PATENT DOCUMENTS

| | | |
|---|---|---|
| GB | 2430020 A | 3/2007 |
| WO | 0140615 A1 | 6/2001 |

(Continued)

OTHER PUBLICATIONS

PCT/US2016/037615 International Search Report and Written Opinion dated Aug. 23, 2016, 13 pages.

(Continued)

*Primary Examiner* — Jennifer H Gay
(74) *Attorney, Agent, or Firm* — Boisbrun Hofman, PLLC

(57) ABSTRACT

A downhole tool and method for reducing friction between a tool string and a sidewall of a wellbore. The downhole tool includes a first wheel, a second wheel, and a hump. When the downhole tool is connected to the tool string, the first wheel, the second wheel, and the hump each extend away from the tool string and collectively define a curved outer profile extending circumferentially around at least a portion of a circumference of the tool string, and the curved outer profile has a geometric center that is offset from a central axis of the tool string.

20 Claims, 9 Drawing Sheets

(56) References Cited

U.S. PATENT DOCUMENTS

| | | | | |
|---|---|---|---|---|
| 10,745,999 | B2 | 8/2020 | Massey | |
| 10,781,647 | B2 * | 9/2020 | Copold | E21B 17/1057 |
| 10,954,726 | B2 * | 3/2021 | Hradecky | E21B 23/14 |
| 11,047,191 | B1 * | 6/2021 | McCormick | E21B 47/01 |
| 11,111,774 | B2 * | 9/2021 | McCormick | E21B 47/01 |
| 2003/0075321 | A1 | 4/2003 | Hall | |
| 2005/0252655 | A1 | 11/2005 | McKay | |
| 2012/0145380 | A1 | 6/2012 | Draper | |
| 2012/0222857 | A1 | 9/2012 | McNay | |
| 2013/0248208 | A1 | 9/2013 | Copold | |
| 2015/0308207 | A1 | 10/2015 | McCormick | |
| 2017/0067299 | A1 | 3/2017 | Copold | |
| 2018/0087337 | A1 | 3/2018 | McCormick | |
| 2018/0119498 | A1 | 5/2018 | Christie | |
| 2018/0135359 | A1 | 5/2018 | Hradecky | |
| 2018/0328131 | A1 | 11/2018 | McCormick | |
| 2018/0363423 | A1 | 12/2018 | Hradecky | |
| 2020/0072001 | A1 | 3/2020 | Morrison | |
| 2020/0208481 | A1 | 7/2020 | McCormick | |
| 2020/0308953 | A1 | 10/2020 | McCormick | |

FOREIGN PATENT DOCUMENTS

| | | | |
|---|---|---|---|
| WO | 2006016155 | A1 | 2/2006 |
| WO | 2014077707 | A1 | 5/2014 |
| WO | 2016170356 | A1 | 10/2016 |
| WO | 2017014871 | A1 | 1/2017 |

OTHER PUBLICATIONS

Stephen McCormick et al; "Innovative Conveyance System Saves $9.4M on a Deep Water, High Angle Well in the Nam Con Son Basin", SPE, Mar. 21, 2017 (Mar. 21, 2017), XP055513400.

PCT/US2018/036938 International Search Report and Written Opinion of the ISA, dated Oct. 10, 2018, 16 pages.

* cited by examiner

TOOL STRING ORIENTATION

CROSS-REFERENCE TO RELATED APPLICATIONS

This application is a continuation of, and claims priority to and the benefit of, U.S. patent application Ser. No. 15/574,633, titled "Tool String Orientation," filed Nov. 16, 2017, which claimed priority to and the benefit of International Patent Application No. PCT/US2016/037615, titled "Tool String Orientation," filed Jun. 15, 2016, which claimed priority to and the benefit of U.S. Provisional Application No. 62/196,229, titled "Tool String Orientation," filed Jul. 23, 2015. The entire disclosures of the above listed applications are hereby incorporated herein by reference.

BACKGROUND OF THE DISCLOSURE

In the oil and gas industry, hydrocarbon reservoirs have conventionally been accessed by vertical or near-vertical wellbores. Such reservoirs, however, are increasingly accessed via non-vertical wellbores.

Tools that have conventionally been used in the vertical or near-vertical wellbores may encounter problems when used in the non-vertical wellbores. Such tools may be lowered into wellbores as part of a tool string utilizing gravity to facilitate transport or movement therethrough. In non-vertical wellbores, gravity may be negated by frictional forces between the tool string and sidewall of the wellbore, thus resisting movement of the tool string through the wellbore. Furthermore, particularly with open-hole wellbores not lined with casing, outer surfaces of the tool string may stick to the sidewall of the wellbore, or edges of the tool string may dig into or jam against imperfections in the sidewall of the wellbore.

Furthermore, some downhole tools achieve optimal performance when oriented in a specific direction within the wellbore. For example, certain formation testing/sampling tools achieve optimal performance when a sensor/probe of the tool faces or even contacts the lower/bottom side of the non-vertical wellbore. However, the increased friction due to the non-vertical nature of the wellbore trajectory impedes intended axial rotation of the tool string relative to the wellbore. Moreover, wireline, coiled tubing, and/or other means of conveying the tool string within the wellbore are often unable to facilitate rotational orientation of the tool string relative to the wellbore, such that rotation of the conveyance means at the wellsite surface is not transferred downhole and imparted to the tool string in the wellbore. Some downhole roller tools facilitate movement of the tool string along non-vertical portions of the wellbore. However, such roller tools do not axially orient the tool string within and relative to the non-vertical wellbore portions.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
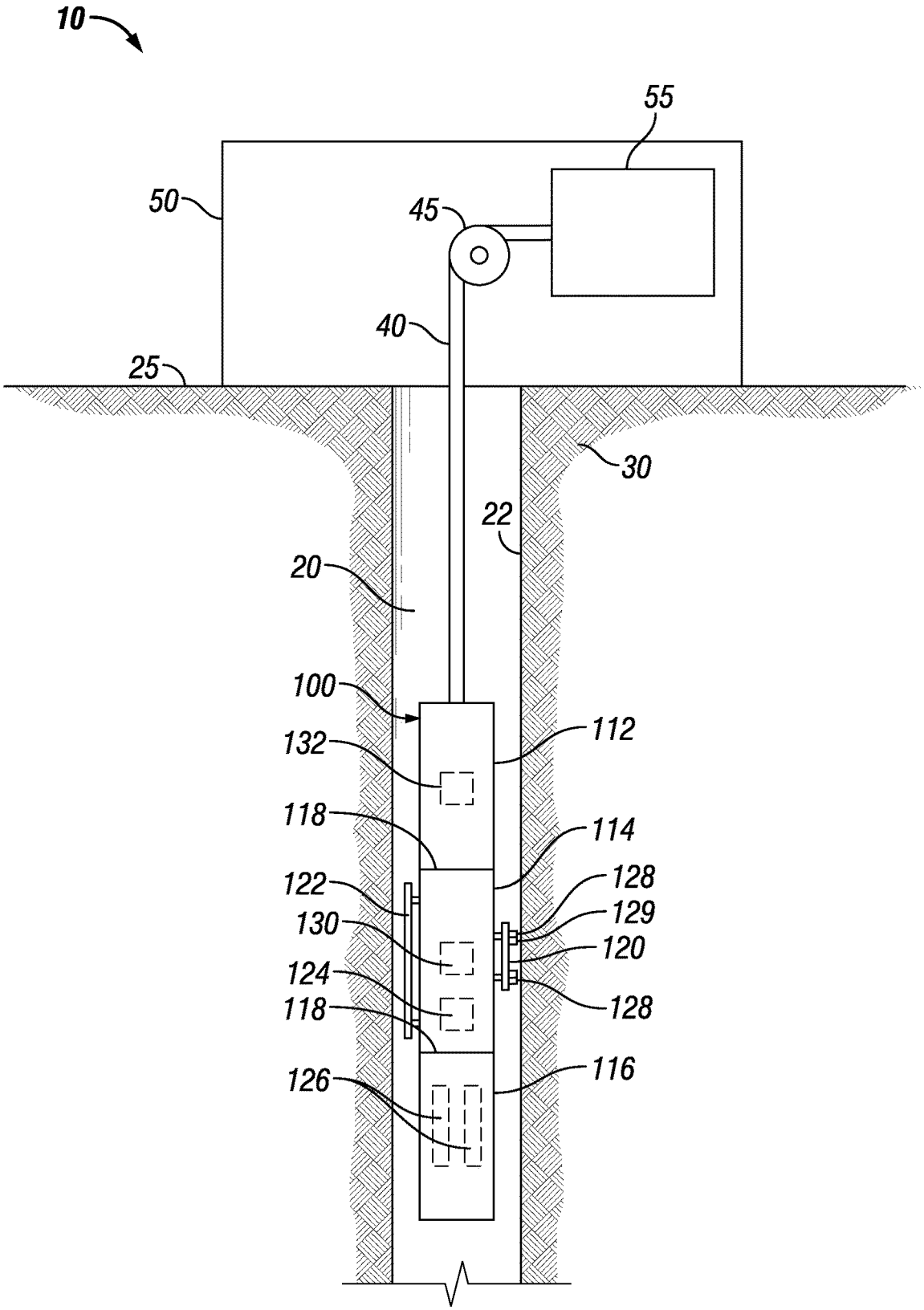
FIG. 1 (Prior Art)
FIG. 1 is a schematic view of prior art apparatus disposed in a substantially vertical wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of a prior art wellsite system 10 utilized in the oil and gas industry. The wellsite system 10 may comprise a tool string 100 suspended within a wellbore 20 that extends from a wellsite surface 25 into one or more subterranean formations 30. The tool string 100 may be suspended within the wellbore 20 via a conveyance means 40 operably coupled with a tensioning device 45 and/or other surface equipment 50 disposed at the wellsite surface 25, including a power and control system 55. The wellbore 20 is depicted as being an open-hole implementation lacking a casing and cement. However, one or more aspects of the present disclosure may be applicable to and/or readily adaptable for utilizing in cased-hole implementations comprising the casing secured by the cement.

The tensioning device 45 may be operable to apply an adjustable tensile force to the tool string 100 via the conveyance means 40. The tensioning device 45 may be, comprise, or form at least a portion of a crane, a winch, a drawworks, a top drive, and/or other lifting device coupled to the tool string 100 by the conveyance means 40. The conveyance means 40 may be or comprise a wireline, a slickline, an e-line, a coiled tubing, and/or other conveyance means spooled at the wellsite surface 25, such as by or in conjunction with the tensioning device 45. The conveyance means 40 may comprise and/or be operable in conjunction with means for communication between the tool string 100, the tensioning device 45, and/or one or more other portions of the surface equipment 50, including the power and control system 55. Accordingly, the conveyance means 40 may also comprise a multi-conductor wireline, perhaps including one or more electrical and/or optical conductors, extending between the tool string 100 and the surface equipment 50.

The tool string 100 may comprise one or more portions, each of which may be, comprise, or form a portion of one or more downhole tools, modules, and/or other apparatus. For example, first, second, and third portions 112, 114, 116 of the tool string 100 may each be or comprise at least a portion of an acoustic tool, a density tool, a directional tool, an electromagnetic (EM) tool, a formation testing tool, a fluid sampling tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a telemetry tool, and/or a mechanical interface tool, among other examples also within the scope of the present disclosure. Although FIG. 1 depicts the tool string 100 comprising three portions 112, 114, 116, it is to be understood that the tool string 100 may comprise a different number of portions connected together to form the tool string 100.

The first, second, and third tool string portions 112, 114, 116 may be connected together, such as via threaded connections (not shown), to form the tool string 100. When connected together, the tool string portions 112, 114, 116 may form recesses or make-up grooves 118 adjacent the threaded connections or other connection means between the tool string portions 112, 114, 116. The make-up grooves 118 may extend radially inward with respect to the outer wall or surface of the tool string portions 112, 114, 116.

In an implementation of the wellsite system 10, the first portion 112 may be or comprise a telemetry tool 112, the second portion 114 may be or comprise a formation testing tool 114, and the third portion 116 may be or comprise a fluid sampling tool 116. Although the telemetry tool 112 is shown as being implemented separate from the formation testing tool 114, the telemetry tool 112 may be implemented as part of the formation testing tool 114.

The formation testing tool 114 may comprise a selectively extendable probe assembly 120 and a selectively extendable anchoring member 122 that are respectively arranged on opposing sides of the formation testing tool 114. The probe assembly 120 may be configured to selectively seal off or isolate selected portions of the sidewall 22 of the wellbore 20. For example, the probe assembly 120 may comprise a sealing pad 129 that may be urged against the sidewall 22 in a sealing manner to prevent movement of fluid into or out of the selected portion of the formation 30 other than through the probe assembly 120. The probe assembly 120 may thus be configured to fluidly couple a pump 124 and/or other components of the formation testing tool 114 to the adjacent formation 30. Accordingly, the formation testing tool 114 may be utilized to obtain fluid samples from the formation 30 by extracting fluid from the formation 30 using the pump 124. A fluid sample may thereafter be expelled through a port (not shown) into the borehole 20, or the sample may be directed to one or more detachable fluid collecting chambers 126 disposed in the sampling tool 116. In turn, the detachable chambers 126 may receive and retain the formation fluid for subsequent testing at the wellsite surface 25, such as at a testing facility.

The formation testing tool 114 may also be utilized to inject fluid into the formation 30 by, for example, pumping the fluid from one or more fluid collecting chambers 126 disposed in the sample tool 116 via the pump 124. Moreover, while the downhole tool 100 is depicted as comprising one pump 124, it may also comprise multiple pumps. The pump 124 and/or other pumps of the tool string 100 may also comprise a reversible pump configured to pump in two directions (e.g., into and out of the formation 30, into and out of the collecting chamber(s) 126 of the sample module).

The probe assembly 120 may comprise one or more sensors 128 adjacent a port of the probe assembly 120, among other possible locations. The sensors 128 may be operable in determining petrophysical parameters of a portion of the formation 30 proximate the probe assembly 120. For example, the sensors 128 may be configured to measure, detect, and/or otherwise generate information related to one or more of pressure, temperature, composition, electric resistivity, dielectric constant, magnetic resonance relaxation time, nuclear radiation, and/or combinations thereof, although other types of sensors are also within the scope of the present disclosure.

The formation testing tool 114 may also comprise a fluid sensing unit 130 through which obtained fluid samples may flow, such as to measure properties and/or composition data of the sampled fluid. For example, the fluid sensing unit 130 may comprise one or more of a spectrometer, a fluorescence sensor, an optical fluid analyzer, a density and/or viscosity sensor, and/or a pressure and/or temperature sensor, among others.

The telemetry tool 112 and/or another portion of the tool string 100 may comprise a downhole controller and/or control system 132 communicatively coupled to the power and control system 55. The power and control system 55 and/or the downhole controller and/or control system 132 may be configured to control the probe assembly 120 and/or the extraction of fluid samples from the formation 30, such as via a pumping rate of the pump 124. The power and control system 55 and/or the downhole controller and/or control system 132 may be further configured to analyze and/or process data obtained from sensors disposed in the fluid sensing unit 130 and/or the sensors 128, store measurements or processed data, and/or communicate the measurements or processed data to the power and control system 55 or another component of the surface equipment 50 for subsequent analysis.

The wellbore 20 containing the tool string 100 is shown substantially vertical, or perpendicular to the wellsite surface 25. The conveyance means 40 may be reeled in and out such that gravity and the unreeled length of the conveyance means 40 primarily dictate the depth of the downhole tool string 100. In a substantially vertical wellbore, such as the wellbore 20 shown in FIG. 1, the vertical sidewall 22 may not substantially impede the intended conveyance or movement of the downhole tool string 100 within the wellbore 20. However, this may not be true for non-vertical wellbores.

Figure 2:
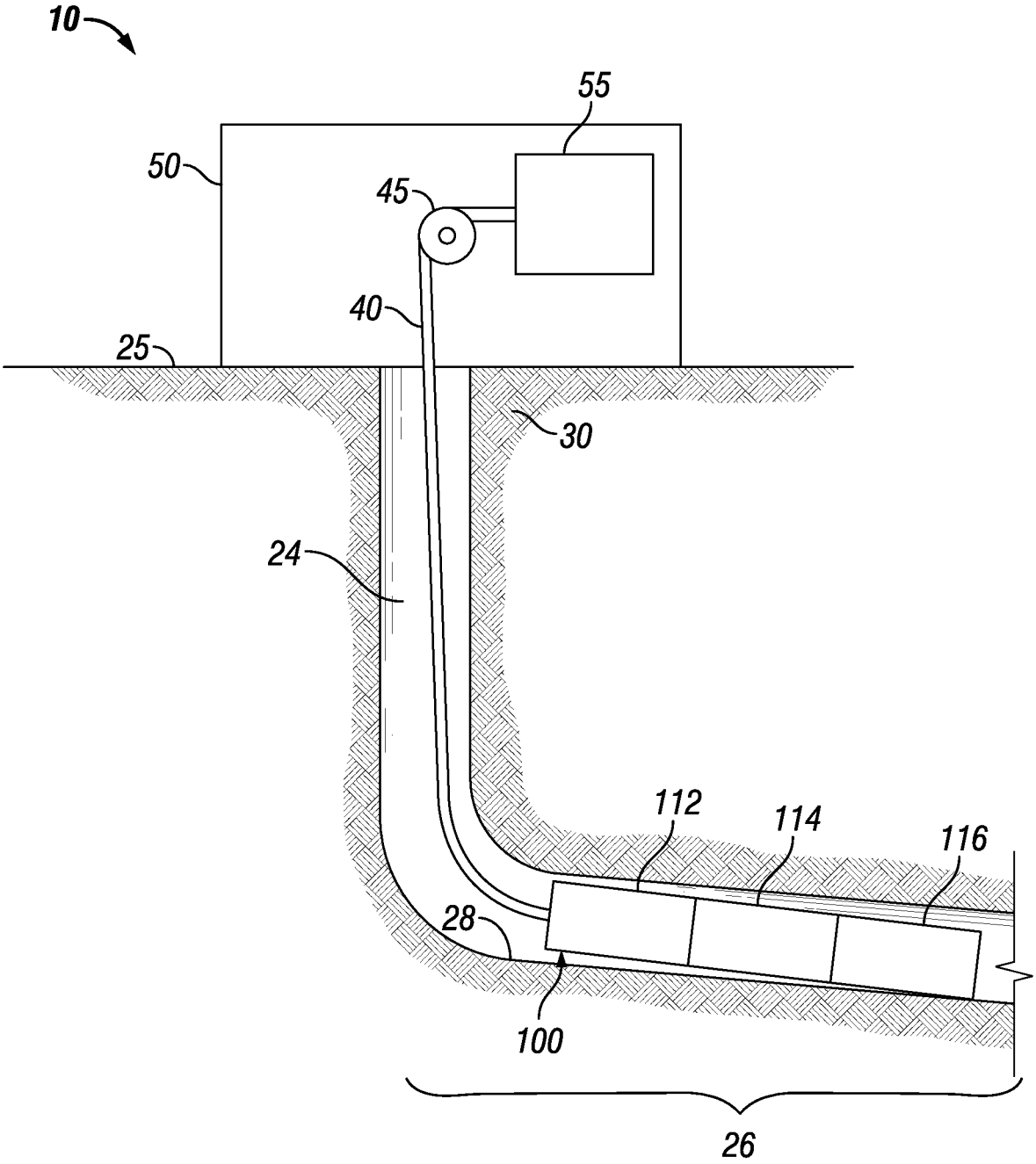
FIG. 2 (Prior Art)
FIG. 2 is a schematic view of the prior art apparatus shown in FIG. 1 disposed in a substantially non-vertical wellbore.

Wells being drilled today are increasingly likely to have at least one section that is not substantially vertical. FIG. 2 is a schematic view of the prior art wellsite system 10 of FIG. 1, showing the downhole tool string 100 suspended in a non-vertical section 26 of a wellbore 24. As a result, the non-vertical sidewall 28 of the non-vertical section 26 of the wellbore 24 may cause contact and/or friction against the downhole tool string 100 and/or otherwise impede the intended conveyance or movement of the downhole tool string 100 through the wellbore 24. Moreover, impacts, friction, vibrations, and other forces resulting from such contact and/or friction may cause damage to the downhole tool string 100 when conveyed through the substantially non-vertical section 26 of the wellbore 24.

Figure 3:
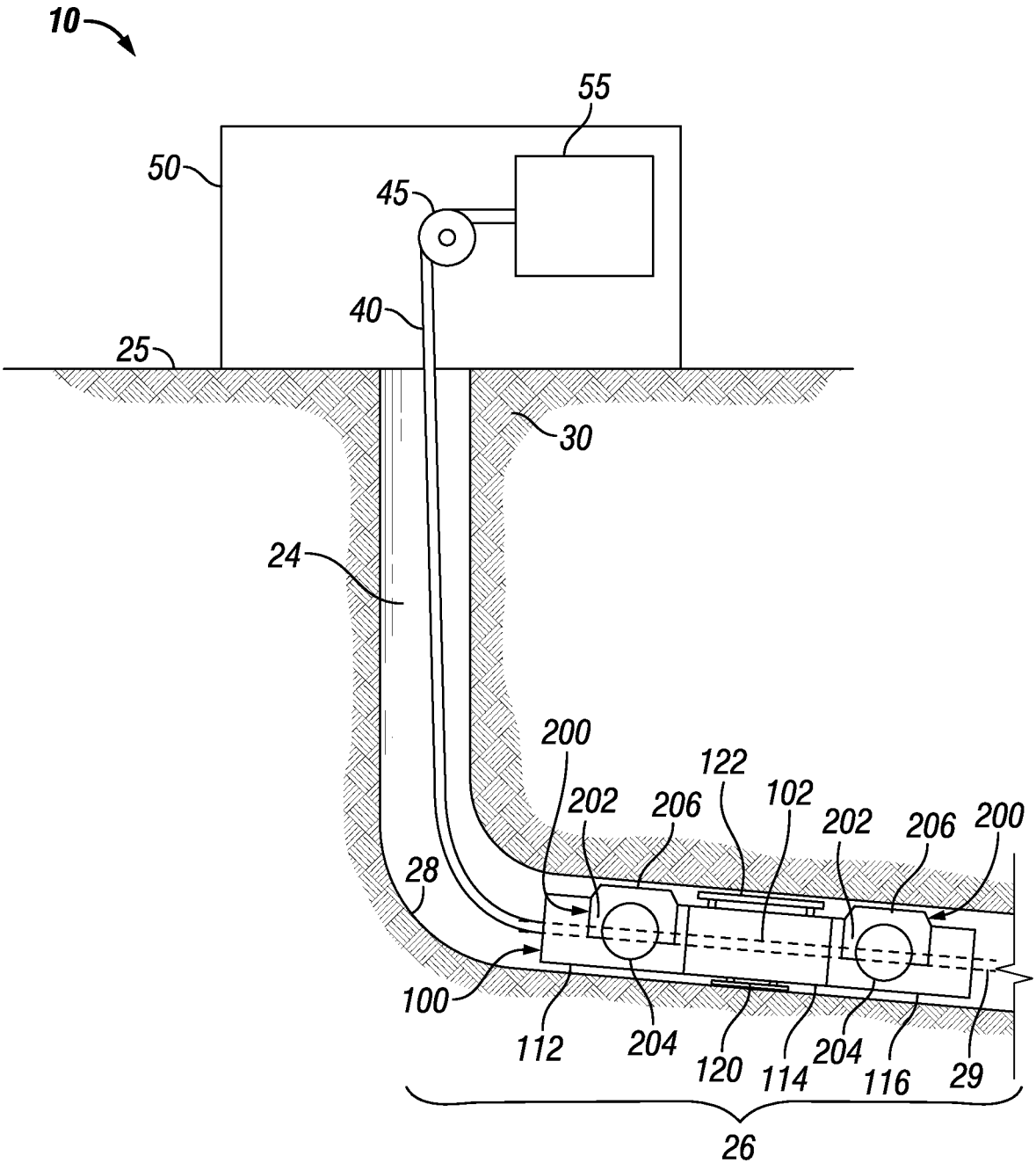
FIG. 3 is a schematic view of at least a portion of apparatus according to one or more aspects of the present disclosure disposed in a substantially non-vertical wellbore.

FIG. 3 is a schematic view of the wellsite system 10 of FIG. 1, showing the downhole tool string 100 suspended in the non-vertical section 26 of the wellbore 24 shown in FIG. 2, but also comprising a tool string orienting apparatus 200 (hereinafter referred to as an "orienting tool") according to one or more aspects of the present disclosure. The orienting tool 200 may be operable to rotate, orient, or aid in orienting the downhole tool string 100 to a selected orientation or rotational position within the non-vertical section 26 of the wellbore 24. The orienting tool 200 may be further operable to translate, convey, or aid in conveying the downhole tool string 100 axially or longitudinally along the non-vertical section 26 of the wellbore 24. Unless described otherwise, the terms orientation, rotational position, and other related terms, as used herein when describing the tool string 100 and orienting tool 200, may refer to rotational or angular direction of the tool string 100 and orienting tool 200 with respect to or about a central axis 29 of the non-vertical portion 26 of the wellbore 24 or another axis extending longitudinally along the non-vertical portion 26 of the wellbore 24. Similarly, unless described otherwise, the term rotation, as used herein when describing the tool string 100 and orienting tool 200, may refer to the angular movement or rotation of the tool string 100 and orienting tool 200 with respect to or about the central axis 29 or another axis extending longitudinally along the non-vertical portion 26 of the wellbore 24.

FIG. 3 shows two orienting tools 200 connected with the tool string 100. However, additional orienting tools 200 may be connected with the tool string 100 depending on various factors, such as length, weight, flexibility, and/or other parameters associated with the tool string 100. The tool string 100 may include three, four, or more orienting tools 200 connected at various positions along the length of the tool string 100. As described below, the orienting tools 200 may be rotationally aligned with each other in a substantially same rotational direction along the tool string 100, such as to facilitate the intended orientation of the whole tool string 100.

The orienting tools 200 may collectively lift or support at least a portion of the tool string 100 at a distance from a bottom portion of the sidewall 28, such as may reduce or prevent contact and/or friction between the tool string 100 and the sidewall 28 as the tool string 100 is conveyed axially along the non-vertical portion 26 of the wellbore 24. The lifting action of the orienting tool 200 may also facilitate an intended offset between the probe/sensor 120 and the sidewall 28. Such offset may be zero in some implementations, such that the orienting tools 200 may be intended to cooperatively position the probe/sensor 120 or another portion of the tool string 100 in contact with the bottom portion of the sidewall 28 of the non-vertical portion 26 of the wellbore 24.

Each orienting tool 200 may comprise orienting features 204 rotatably disposed on opposing sides of the tool string 100 for rotation about corresponding axes of rotation, and extending radially outward with respect to the tool string 100. The orienting features 204 may be operable to rotate or otherwise orient the orienting tool 200 and, thus, the tool string 100 connected with the orienting tool 200, toward an intended rotational position within the non-vertical section 26 of the wellbore 24. For example, the axes of rotation of the orienting features 204 may be radially offset from a central axis of the tool string 100 in a manner that urges and/or otherwise results in the tool string 100 tipping over or otherwise reorienting from an unintended to an intended rotational position. In the intended rotational position, as depicted in FIG. 3, the axes of rotation of the orienting features 204 may be disposed above (e.g., opposite the direction of gravity) the central axis 29 of the tool string 100, such that the probe/sensor 120 abuts or faces the lower portion of the non-vertical portion 26 of the wellbore 24. The orienting features 204 may also facilitate axial conveyance of the tool string 100 along the sidewall 28 of the non-vertical section 26 of the wellbore 24, such as in implementations in which the orienting features 204 are or comprise rollers, including as described below.

Each orienting tool 200 may also comprise another orienting feature 206 extending radially outward with respect to the tool string 100. The orienting features 206 may also aid in rotation of the tool string 100 toward the intended rotational position within the non-vertical section 26 of the wellbore 24. For example, a centerline 102 of the assembly of the tool string 100 and the orienting tools 200 can be considered as the line that extends parallel to the central axis 29 of the tool string 100 but offset in a radial direction toward the orienting features 206 by an amount equal to the average of the offsets (relative to the central axis 29 of the tool string 100) of the centroids of the cross-sectional shapes at infinite axial locations along the length of the assembly. The radial offset of the centerline 102 from the center of mass of the assembly of the tool string 100 and the orienting tools 200 creates a mechanical instability when the centerline 102 is not located directly above the center of mass of the assembly, such that gravity will urge the rotation of the assembly toward a mechanically stable condition in which the centerline 102 is located directly above the center of mass of the assembly.

Each orienting tool 200 may also comprise a body, chassis, or other frame 202, which may be operable to clamp, grip, or otherwise connect the orienting tool 200 with an outer wall or surface of the tool string 100 in a manner preventing movement of the frame 202 relative to the tool string 100. The orienting features 204, 206 may also be connected with the frame 202.

Although the tool string 100 and the orienting tools 200 are shown deployed within a wellbore 24 lacking a casing, it is to be understood that the orienting tool 200 described herein may also be deployed or otherwise utilized within a casing or another tubular disposed within the wellbore 24. Accordingly, the space through which the tool string 100 and the orienting tool 200 are to be conveyed will be referred to hereinafter as a "passage."

Figure 4:
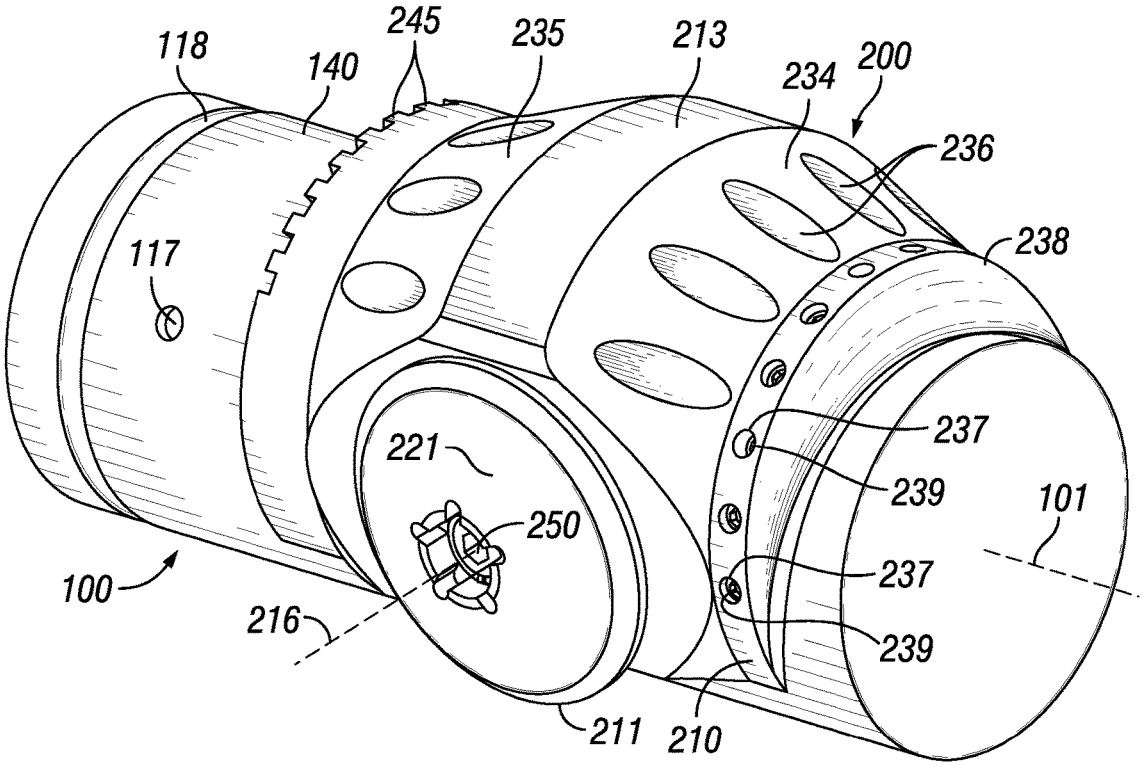
FIG. 4 is a perspective view of a portion of an example implementation of the apparatus shown in FIG. 3 according to one or more aspects of the present disclosure.
Figure 5:
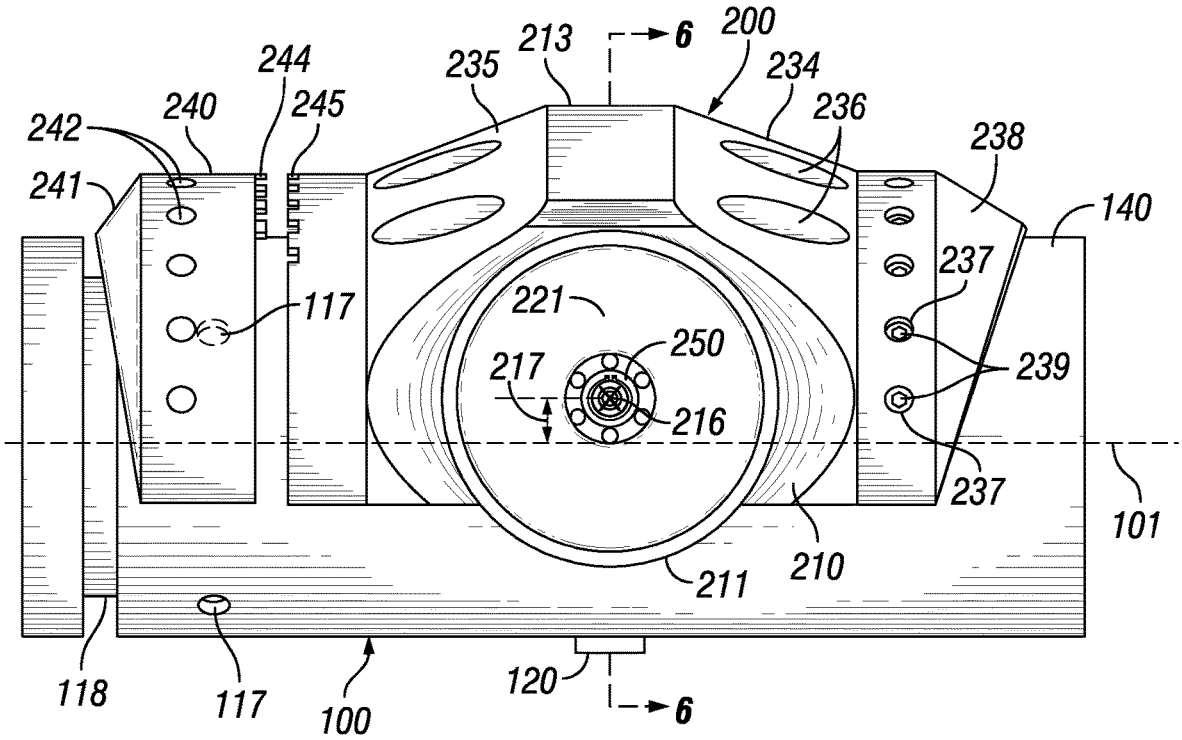
FIG. 5 is a side view of a portion of the apparatus shown in FIG. 4 according to one or more aspects of the present disclosure.
Figure 6:
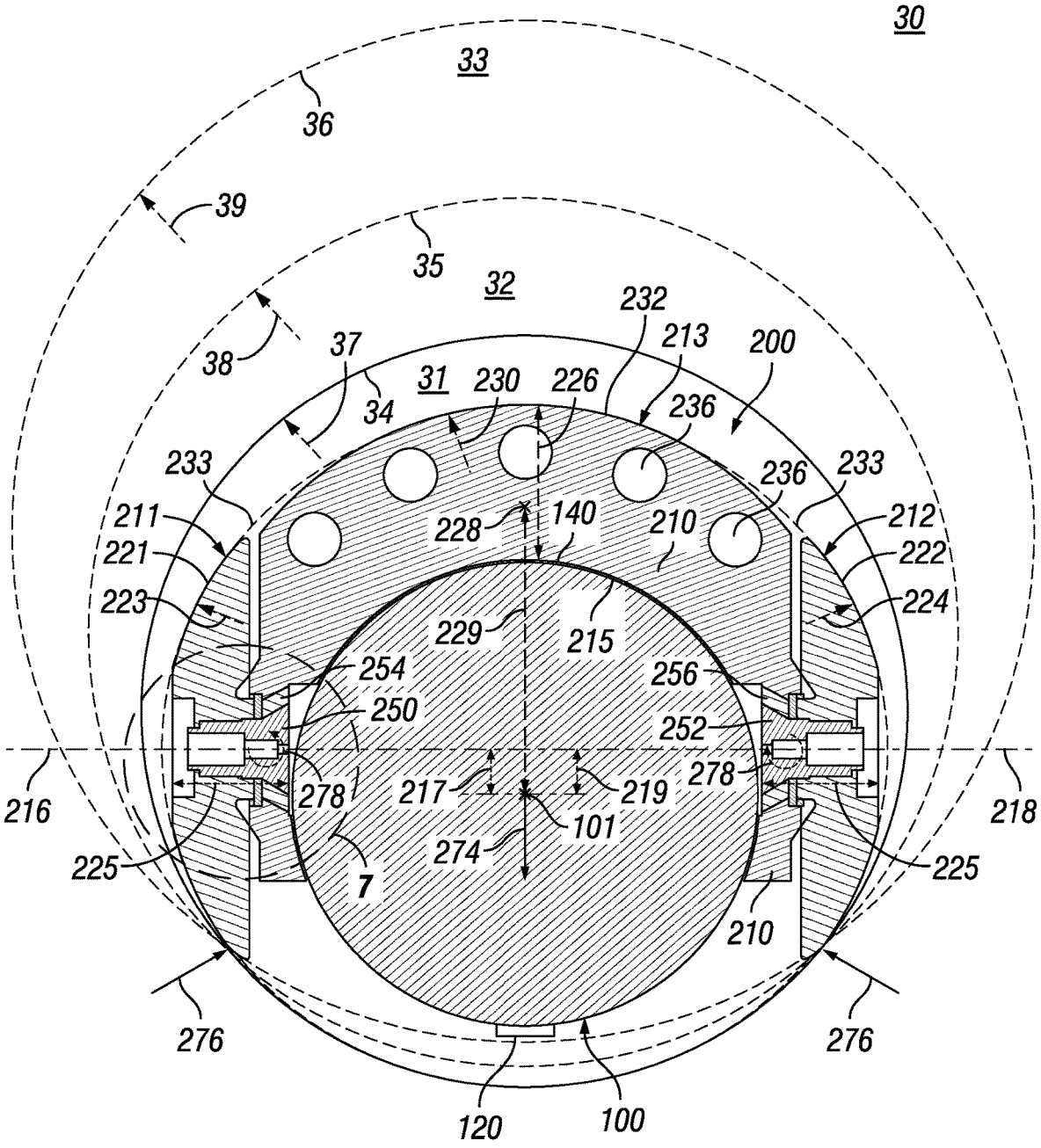
FIG. 6 is a sectional axial view of a portion of the apparatus shown in FIG. 4 according to one or more aspects of the present disclosure.

FIGS. 4, 5, and 6 are perspective, side, and axial views of a portion of an example implementation of the tool string 100 and one of the orienting tools 200 shown in FIG. 3 according to one or more aspects of the present disclosure. The following description refers to FIGS. 4-6, collectively.

As described above, the orienting tool 200 may be connected with the tool string 100 and operable to orient the tool string 100 within the passage 31. The orienting tool 200 may comprise first and second orienting features 211, 212 rotatably connected on opposing sides of the downhole tool string 100, for example, via a body, chassis, or other frame 210 operable for connection with the tool string 100. The orienting tool 200 may further comprise a third orienting feature 213 extending radially outward with respect to the tool string 100 between the first and second orienting features 211, 212. The third orienting feature 213 may be a standoff, hump, wedge, or other feature, and may be connected with the tool string 100 and/or the first and second orienting features 211, 212 via the frame 210.

The frame 210 may be operable to engage an outer surface 140 of the tool string 100 in a manner preventing movement of the frame 210 and, thus, the first, second, and third orienting features 211, 212, 213 relative to the tool string 100. The outer surface 140 may include one or more external features, such as grooves, recesses, and depressions, among other examples. The frame 210 may extend around at least a portion of a circumference of the tool string 100. For example, the frame 210 may extend around a majority of the circumference of the tool string 100, but not around the entire circumference of the tool string 100. The frame 210 may also comprise an inner surface 215 defining a void operable to receive the outer surface 140 of the tool string 100. The inner surface 215 of the frame 210 may extend around at least a portion of the circumference of the tool string 100. For example, the inner surface 215 may extend around a majority of the circumference of the tool string 100, but not around the entire circumference of the tool string 100. Such implementations may permit the tool string 100 to be captured or otherwise retained within the void defined by the inner surface 215, such as to help maintain connection between the frame 210 and the tool string 100. Such implementations may also prevent rotation of the frame 210 relative to the tool string 100, such as may permit a predetermined side of the tool string 100 (e.g., comprising the probe/sensor 120) to be disposed in close proximity to a bottom portion of a sidewall 34 of the passage 31 and/or minimize the spacing between the predetermined side of the tool string 100 and the bottom portion of the sidewall 34.

The first orienting feature 211 may be connected with a first side of the frame 210 and rotate relative to the frame 210 about a first axis of rotation 216. The first axis of rotation 216 is offset from the central axis 101 of the tool string 100 by a distance 217. Similarly, the second orienting feature 212 may be connected to a second side of the frame 210 (opposite the first side) and rotate relative to the frame 210 about a second axis of rotation 218. The second axis of rotation 218 is offset from the central axis 101 of the tool string 100 by a distance 219. Accordingly, the axes of rotation 216, 218 may be located above or otherwise offset from the central axis 101 of the tool string 100, such as to maintain a center of gravity of the tool string 100, which may coincide with the central axis 101, below the axes of rotation 216, 218 of the orienting features 211, 212. The first and second axes of rotation 216, 218 may extend substantially perpendicularly with respect to the central axis 101 of the tool string 100. The first and second axes of rotation 216, 218 may be substantially collinear, such that the distances 217, 219 may be substantially equal. Larger offset distances 217, 219 between the axes of rotation 216, 218 and the central axis 101 will increase the tendency of the tool string 100 and the orienting tool 200 to rotate such that the center of gravity is located below the axes of rotation 216, 218.

The first and second orienting features 211, 212 may each be or comprise a roller operable roll along the sidewall 34 and thereby facilitate axial conveyance of the tool string 100 within the passage 31. The rollers may also be operable to support the tool string 100 at an intended offset distance from the sidewall 34. Each roller of the first and second orienting features 211, 212 may be disk or bowl shaped, comprising curved outer surfaces or profiles 221, 222 each having a radius 223, 224 that may be smaller than a radius 37 of the sidewall 34 of the passage 31.

FIG. 6 is an axial view of a portion of an example implementation of the tool string 100 and the orienting tool 200 disposed within the passage 31. The passage 31 is depicted in FIG. 6 as defined by the sidewall 34 (having the radius 37) and extending non-vertically through the subterranean formation 30. However, it is to be understood that the tool string 100 and the orienting tool 200 may be disposed within different sized passages, such as passages 32, 33 defined by sidewalls 35, 36 and extending non-vertically through the subterranean formation 30. The sidewall 35, 36 of each passage 32, 33 may have a corresponding radius 38, 39.

Portions of the tool string 100, such as the probe/sensor 120, located at the bottom side of the tool string 100, may be located below points of contact between the first and second orienting features 211, 212 and the sidewall 34, 35, 36 and, thus, in close proximity to the bottom portion of the sidewall 34, 35, 36. As the passage size increases and the radius 37, 38, 39 of the sidewall 34, 35, 36 increases, clearance or spacing between the bottom side of the tool string 100 and the sidewall 34, 35, 36 may progressively decrease, such that the probe/sensor 120 or another portion of the tool string 100 may be located closer to the bottom portion of the sidewall 34, 35, 36. Although such implementations may increase the tendency of the tool string 100 and the orienting tool 200 to rotate such that the center of gravity of the tool string 100 is closest to the bottom portion of the sidewall 34, 35, 36, the bottom side of the tool string 100 may contact the sidewall 34, 35, 36 if the passage 31, 32, 33 is too large for the orienting tool 200.

The third orienting feature 213 may extend radially outward with respect to the tool string 100 between or interposing the first and second orienting features 211, 212. The third orienting feature 213 and the axes of rotation 216, 218 may be located on the same side of the central axis 101 of the tool string 100. The third orienting feature may have a center of mass 228 that is offset from the central axis 101 of the tool string 100 in a radial direction by a distance 229. The center of mass 228 and the central axis 101 may be on opposing sides of the first and second axes of rotation 216, 218, such that the first and second axes of rotation 216, 218 each interpose the center of mass 228 of the third orienting feature 213 and the central axis 101.

Similarly to the first and second orienting features 211, 212, the third orienting feature 213 may comprise a curved outer surface or profile 232 having a radius 230. The radius 230 may be smaller than the radius 37 of the sidewall 34 of the passage 31. The outer profile 232 of the third orienting feature extends just partially around the circumference of the tool string 100, such as substantially continuously between the first and second orienting features 211, 212. The curved outer profiles 221, 222 of the first and second orienting features 211, 212 may each extend radially outward from the tool string 100 to a first distance 225, while the curved outer profile 232 of the third orienting feature 213 may extend radially outward from the tool string 100 to a second distance 226. The second distance 226 may be substantially greater than the first distance 225. However, the second distance 226 (i.e., the radial thickness of the third orienting feature 213) may progressively decrease or taper along the length of the curved outer profile 232, such as in directions extending from a central portion (i.e., located above the central axis 101) of the third orienting feature 213 to the first and second orienting features 211, 212, resulting in a substantially smooth transition between the first, second, and third orienting features 211, 212, 213.

Accordingly, the first, second, and third orienting features 211, 212, 213 may collectively form a substantially continuous curved outer profile 233 extending partially around the circumference of the tool string 100. While the substantially continuous curved outer profile 233 may not extend around the entire circumference of the tool string 100, it may extend around a majority of the circumference of the tool string 100. Because each curved outer profile 221, 222, 232 may have a radius 223, 224, 232 that is smaller than the radius 37, the substantially continuous curved outer profile 233 may also have a radius that is smaller than the radius 37. The substantially continuous curved outer profile 233 may be substantially elliptical or circular and, thus, have a geometric center. The geometric center may be located along the axes of rotation 216, 218 at a mid-point between the first and second orienting features 211, 212. Accordingly, the geometric center may be offset from the central axis 101 of the tool string 100 by the distance 217, 219. Once an orienting tool 200 is connected with the tool string 100, the substantially continuous curved outer profile 233 substantially encompasses the tool string 100 and, thus, the geometric center of the substantially continuous curved outer profile 233 also becomes a geometric center, but not a center of mass, of an assembly comprising the tool string 100 and the orienting tool 200. Because the mass of the tool string 100 is substantially greater than the mass of the orienting tool 200, the offset creates a mechanical instability of the assembly of the tool string 100 and the orienting tools 200 when the central axis 101 and, thus, center of mass of the tool string 100 is not located directly below the geometric center of the substantially continuous curved outer profile 233. Such mechanical instability will result in gravity (i.e., weight of the tool string 100) urging rotation of the assembly toward a mechanically stable orientation in which the central axis 101 of the tool string 100 is located directly below the geometric center of the substantially continuous curved outer profile 233, as shown in FIGS. 4-6.

Although the third orienting feature 213 is depicted in FIGS. 4-6 as being integral to the frame 210, the third orienting feature 213 may be a distinct member fixedly connected with the frame 210, such as via screws, bolts, latches, and interference fit, among other examples. Also, instead of being connected together via the frame 210, the third orienting feature 213 and the first and second orienting features 211, 212 may be separate and distinct members, each connected independently with the tool string 100 via corresponding frames.

The orienting tool 200 may further comprise downhole and uphole facing surfaces 234, 235 providing a gradual transition between the third orienting feature 213 and the frame 210. The surfaces 234, 235 may be rounded, sloped, tapered, and/or otherwise shaped with respect to the central axis 101 of the downhole tool 100 in a manner that may decrease friction between the orienting tool 200 and the sidewall 34 and/or wellbore fluid while the orienting tool 200 and the tool string 100 are conveyed through the passage 31. The orienting tool 200 may also include a plurality of holes 236 extending through the third orienting feature 213 between the downhole and uphole surfaces 234, 235 and perhaps substantially parallel to the central axis 101 of the tool string 100. The holes 236 may permit the passage of wellbore fluid and, thus, further decrease friction forces between the orienting tool 200 and the wellbore fluid as the orienting tool 200 and the tool string 100 are conveyed through the passage 31. A downhole end of the frame 210 may terminate with a surface 238, which may also be rounded, sloped, tapered, and/or otherwise shaped with respect to the central axis 101 of the downhole tool 100 in a manner that may decrease friction between the orienting tool 200 and the sidewall 34 and/or wellbore fluid as the orienting tool 200 and the tool string 100 are conveyed through the passage 31.

As described above, the frame 210 may be operable to engage the outer surface 140 of the tool string 100 in a manner preventing movement of the frame 210 relative to the tool string 100. For example, the frame 210 may include a plurality of setscrews 239 extending through corresponding holes 237 in the frame 210 for contacting the outer surface 140 of the tool string 100. The setscrews 239 may be rotated such that the setscrews 239 advance past the inner surface 215 of the frame 210 and engage the outer surface 140 of the tool string 100 to generate friction between the setscrews 239 and the outer surface 140 of the tool string 100. Accordingly, when tightened against the outer surface 140 of the tool string 100, the setscrews 239 may reduce or prevent axial and/or rotational movement of the frame 210 with respect to the tool string 100.

The orienting tool 200 may also comprise a locking member 240 utilized to maintain the orienting tool in an intended rotational and axial position with respect to the tool string 100. The locking member 240 may be utilized instead of or in addition to the setscrews 239. Similarly to the frame 210, the locking member 240 may extend around at least a portion of the circumference of the tool string 100. For example, the locking member 240 may extend around a majority of the circumference of the tool string 100, but not the entire circumference of the tool string 100. The locking member 240 may be slidably disposed about the outer surface 140 of the tool string 100 until the locking member 140 is locked or otherwise fixedly connected with the tool string 100.

An uphole end of the locking member 240 may terminate with a surface 241, which may be rounded, sloped, tapered, and/or otherwise shaped with respect to the central axis 101 of the downhole tool 100 in a manner that may decrease friction between the orienting tool 200 and the sidewall 34 and/or wellbore fluid as the orienting tool 200 and the tool string 100 are conveyed through the passage 31. Similarly to the frame 210, the locking member 240 may comprise a plurality of holes 242 extending through the frame 210 substantially perpendicular to the central axis 101 of the tool string 100. Each of the holes 242 may be threaded and for receiving corresponding setscrews (not shown), which may be rotated within the corresponding holes 242 until the setscrews engage the outer surface 140 of the tool string 100 to generate friction between the setscrews 239 and the outer surface 140 of the tool string 100.

Prior to engaging the setscrews against the outer surface 140 of the tool string 100, the locking member 240 may be moved about the outer surface 140 of the tool string 100 until one or more of the holes 242 and the corresponding setscrews may be aligned with one or more holes 117 (such as for receiving a spanner wrench) located along the outer surface 140 of the tool string 100. Thereafter, the one or more aligned setscrews may be rotated such that the setscrews advance into the corresponding holes 117, perhaps until engaging the bottom end of the holes 117. The holes 117 may help maintain the corresponding setscrews in position along the outer surface 140 of the tool string 100 and, thus, provide additional resistance against relative rotational and/or axial movement between the locking member 240 and the tool string 100. The setscrews within the remaining holes 242 may also be rotated until the setscrews engage the outer surface 140 of the tool string 100. Instead of or in addition to engaging the setscrews of the locking member 240 within the holes 117, the setscrews may be engaged within or latch against a make-up groove 118 between adjacent first, second, and/or third portions 112, 114, 116 of the tool string 100 and/or other grooves, recesses, depressions, or features located along the outer surface 140 of the tool string 100.

A downhole end of the locking member 240 may comprise one or more alignment features 244 operable to engage corresponding alignment features 245 located at an uphole end of the frame 210. The alignment features 244, 245 may be or comprise protrusions, keys, teeth, notches, grooves, slots, or other features that, when engaged, may prevent the frame 210 and the locking member 240 from rotating relative to each other. Accordingly, once the locking member 240 is engaged with the tool string 100, the frame 210 may be rotatably oriented as intended and moved against the locking member 240, such that the alignment features 244, 245 become engaged. Once the orienting tool 200 is oriented as intended and the alignment features 244, 245 are engaged, the setscrews 239 may be rotated until the setscrews 239 engage the holes 117 and/or outer surface 140 of the tool string 100 to lock the frame 210 in position about the tool string 100 and in engagement with the locking member 240.

The frame 210 and the orienting features 211, 212, 213 may be oriented with respect to the tool string 100 such that certain features of the tool string 100, for example, the probe/sensor 120, may be aligned against an intended portion of the sidewall 34 of the passage 31. For example, one or more orienting tools 200 may be oriented with respect to the tool string 100 to cause the probe/sensor 120 to be oriented in a substantially downward direction (i.e., in the direction of gravity) toward or against the bottom portion of the sidewall 34. In such implementations, the orienting tools 200 may be connected to the tool string 100 such that the probe/sensor 120 may be disposed between the first and second orienting features 211, 212, and the central axis 101 of the tool string 100 is located between the probe/sensor 120 and the axes of rotation 216, 218. However, in other implementations within the scope of the present disclosure, the orienting tools 200 may orient the probe/sensor 120 and/or other portions of the tool string 100 at other predetermined angular positions. For example, as shown in FIGS. 3, 5, and 6, the orienting tools 200 may be positioned relative to the tool string 100 such that the probe/sensor 120 is angularly positioned at six o'clock (e.g., substantially downward, in the direction of gravity), while in other implementations within the scope of the present disclosure, the orienting tools 200 may be positioned relative to the tool string 100 such that the probe/sensor 120 is positioned at twelve o'clock (substantially upward, opposite gravity), three o'clock (from left-to-right relative to the page in FIG. 6), nine o'clock (from right-to-left relative to the page in FIG. 6), and points between these positions. When multiple orienting tools 200 are utilized along the tool string 100, each of the orienting tools 200 or a portion of the orienting tool 200 may be rotatably oriented as intended with respect to the other. For example, each orienting tool 200 may be oriented about the tool string 100 such that each of the third orienting features 213 extends in the same radial direction.

Figure 7:
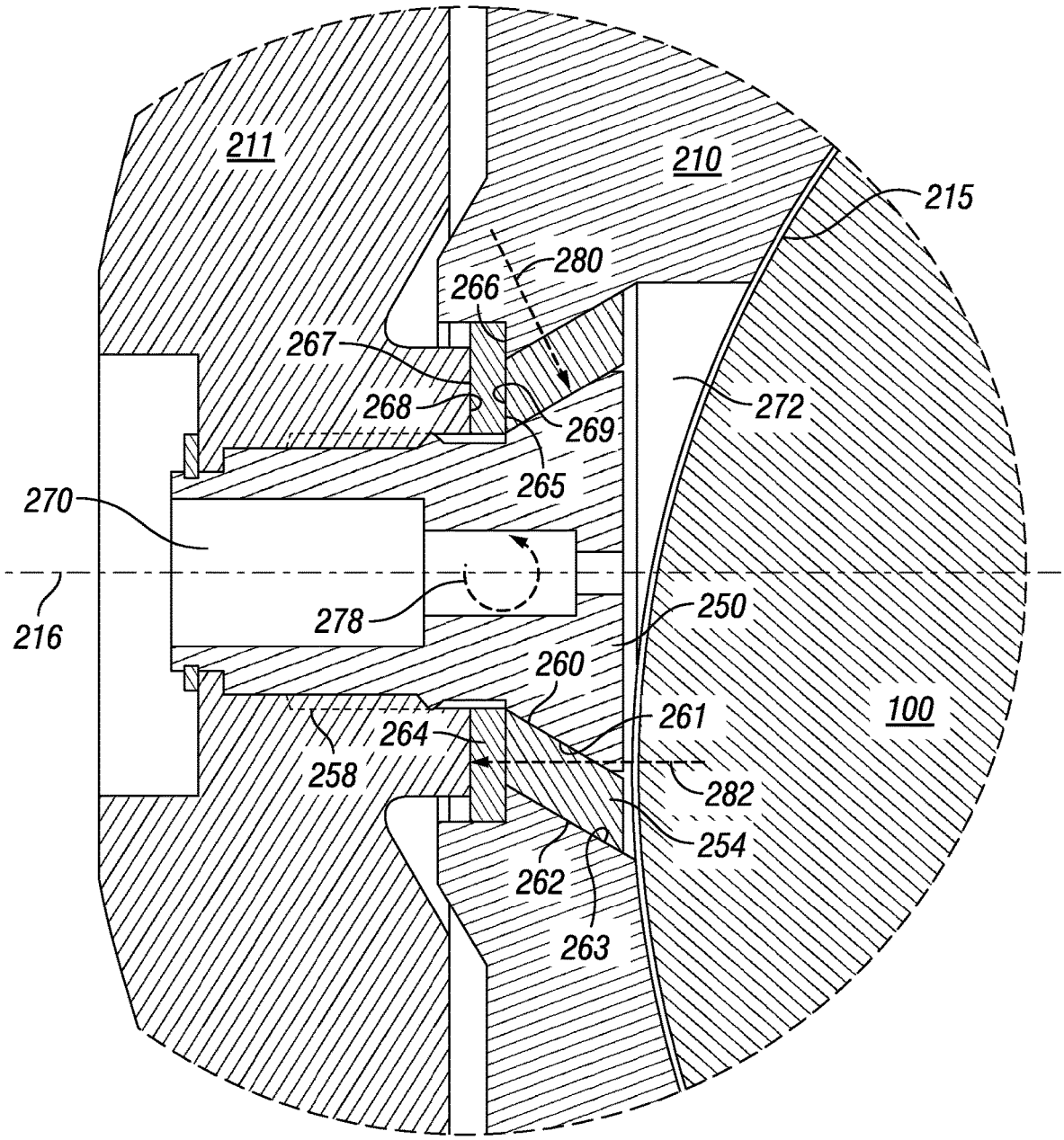
FIG. 7 is an enlarged view of a portion of the apparatus shown in FIG. 6 according to one or more aspects of the present disclosure.

Each of the first and second orienting features 211, 212 may be rotatably connected with the frame 210 via a corresponding axle 250, 252 and bushing 254, 256. FIG. 7 is an enlarged view of a portion of the orienting tool 200 shown in FIG. 6 according to one or more aspects of the present disclosure. The following description refers to FIGS. 6 and 7, collectively.

The axle 250 may extend between the orienting feature 211 and the frame 210. For example, the axle 250 may be fixedly coupled with the orienting feature 211 via coupling means 258, such as corresponding threads, keys, gears, splines, snap rings, screws, bolts, and interference fit, among other examples. The axle 250 may be rotatably connected with the frame 210 via one or more bushings 254 extending about the axle 250 and disposed between the axle 250 and the frame 210. The bushing 254 may comprise a frustoconical geometry and be disposed about a corresponding portion of the axle 250 comprising a complementary frustoconical geometry, such that a frustoconical inner surface 260 of the bushing 254 abuts a corresponding frustoconical outer surface 261 of the axle 250. The bushing 254 may also abut a portion of the frame 210 such that a frustoconical outer surface 262 of the bushing 254 abuts a corresponding frustoconical inner surface 263 of the frame 210. The frustoconical surfaces 260-263 may be inwardly tapered or converge with respect to the axis of rotation 216 in a direction away from the tool string 100.

The orienting tool 200 may further comprise another bushing 264 extending about the axle 250. The bushing 264 may be disposed between the frame 210 and the orienting feature 211 such that a surface 265 of the bushing 264 abuts a corresponding surface 266 of the frame 210, and an opposing surface 267 of the bushing 264 abuts a corresponding surface 268 of the orienting feature 211. The bushing 264 may also be disposed between the orienting feature 211 and the bushing 254 such that the surface 265 of the bushing 264 abuts a corresponding surface 269 of the bushing 254. The surfaces 265-269 may be substantially parallel with respect to each other and extend perpendicularly with respect to the axis of rotation 216. The bushings 254, 264 may comprise a carbon composite, polytetrafluoroethylene (PTFE), bronze, and/or other materials that may reduce rotational friction between the axle 250 and frame 210.

The axle 250 may comprise a port 270 extending between an area external to the orienting tool 200 and a void collectively defined by the axle 250, the bushing 254, the frame 210, and the tool string 100. The port 270 may be utilized to introduce a lubricant (not shown) into the void 272, whereby the lubricant may come into contact with the bushing 254. As the orienting tool 200 and the tool string 100 are conveyed within the passage 31, the lubricant may flow or otherwise enter spaces around the bushings 254, 264 and, thus, lubricate the bushings 254, 264.

While facilitating or permitting rotation and axial movement of the tool string 100 with respect to the passage 31, the bushings 254, 264 may also support the weight of the tool string 100, as well as a torque that may be imparted to the first and second orienting features 211, 212 by the weight of the tool string 100 when conveyed along the passage 31. The weight of the tool string 100 may be approximated by a force 274 applied in the direction of gravity at the center of gravity of the tool string 100, which may substantially coincide along the central axis 101 of the tool string 100. The downward force 274 may cause reaction forces 276 to be imparted by the sidewall 34 to the first and second orienting features 211, 212 in a direction that is normal to the sidewall 34 at a point of contact with the first and second orienting features 211, 212. The reaction forces 276, in turn, may impart a torque 278 to each of the first and second orienting features 211, 212 and the corresponding axles 250, 252.

As shown in FIG. 7, the downward force 274 and the torque 278 transmitted to the axle 250 via the first orienting feature 211 may cause the bushing 254 to impart to the axle 250 a reaction force 280 along a direction normal to the surface 262 of the bushing 254 to maintain the axle 250 from rotating in the direction of the torque 278. Furthermore, the torque 278 applied to the first orienting feature 211 may cause the bushing 264 to impart to the first orienting features 211 a reaction force 282 along a direction normal to the surface 267 of the bushing 264 to maintain the first orienting feature 211 from rotating in the direction of the torque 278. Accordingly, the bushings 254, 264 may collectively resist the downward force 274 (i.e., weight of the tool string 100) and the torque 278 imparted to the first and second orienting features 211, 212 and the axels 250, 252.

Figure 8:
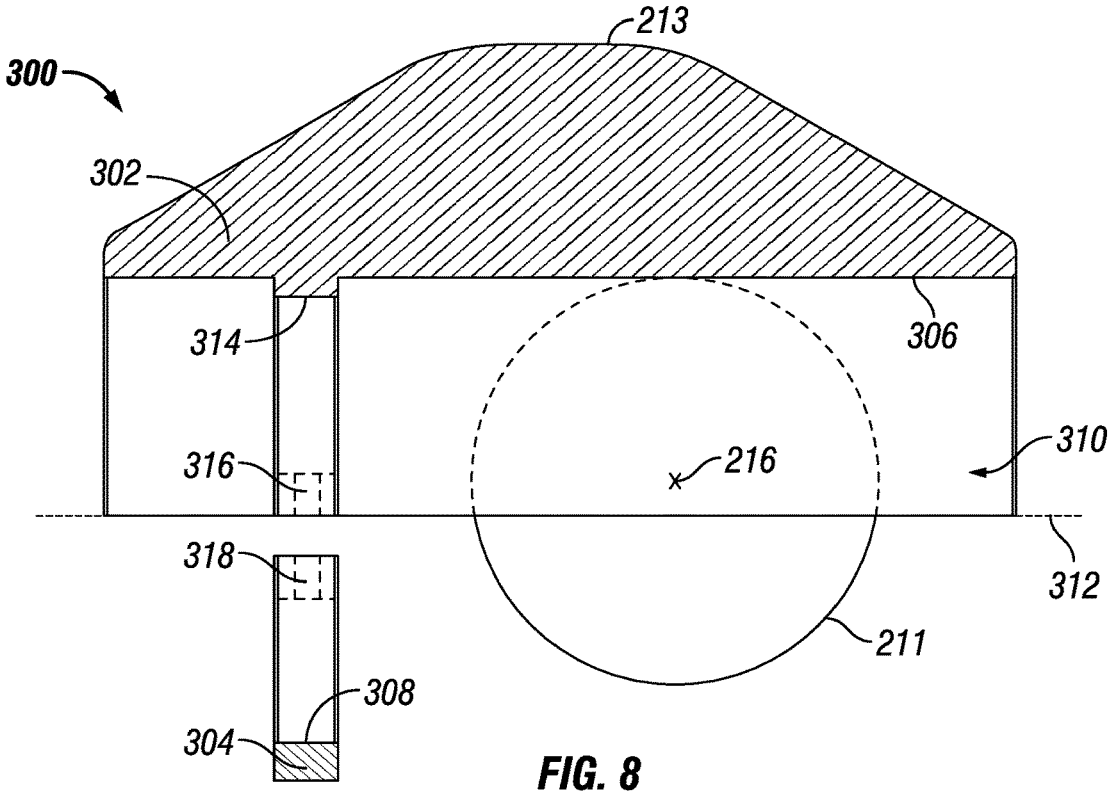
FIG. 8 is a sectional side view of a portion of an example implementation of the apparatus shown in FIG. 3 according to one or more aspects of the present disclosure.

FIG. 8 is a side sectional view of a portion of another example implementation of the orienting tool 200 shown in FIGS. 3-7 according to one or more aspects of the present disclosure, and designated in FIG. 8 by reference numeral 300. The orienting tool 300 is substantially similar in structure and operation to the orienting tool 200, including where indicated by like reference numbers, except as described below. The following description refers to FIGS. 5, 6, and 8, collectively.

The orienting tool 300 may comprise first, second, and third orienting features 211, 212, 213 connected with a frame assembly having an upper frame 302 and a lower frame 304. Each of the upper and lower frames 302, 304 may comprise a corresponding inner surface 306, 308 collectively defining a void 310 operable to receive at least a portion of the outer surface 140 of the tool string 100. The upper and lower frames 302, 304 may be disposed on opposing sides of the tool string 100 such that the opposing inner surfaces 306, 308 may collectively extend around the entire circumference of the tool string 100. The upper and lower frames 302, 304 may be disposed on opposing sides of the tool string 100, and may be connected together to clamp or otherwise hold onto the tool string 100. Such frame configuration may permit the tool string 100 to be captured or otherwise retained within the collective void 310, such as to maintain connection between the upper and lower frames 302, 304 and the tool string 100.

The collective void 310 may have a central axis 312 that coincides with the central axis 101 of the tool string 100, and thus located below the axes of rotation 216, 218 of the first and second orienting features 211, 212. Accordingly, the center of gravity of the tool string 100 may be offset from the axes of rotation 216, 218 of the first and second orienting tools 211, 212 to urge the tool string 100 and the orienting tool 300 to rotate, as described herein.

The upper frame 302 may further comprise a protrusion or a lip 314 extending radially inward from the inner surface 306, such as may be at least partially inserted into the make-up groove 118 of the tool string 100. The lower frame 304 may also be configured such that at least a portion of the lower frame 304, or substantially all of the lower frame 304, may be received within or accommodated by the make-up groove 118. Such implementations may permit the orienting tool 300 to grip the tool string 100 along the make-up groove 118 to reduce or prevent the orienting tool 300 from rotating about the tool string 100 and/or moving axially along the tool string 100. Such implementations may also permit the lower frame 304 to be substantially flush with the outer surface 140 of the tool string 110 to minimize the spacing between the tool string 100 and the bottom portion of the sidewall 34. Although portions of the upper and lower frames 302, 304 may be disposed within the make-up groove 118, portions of the upper and lower frames 302, 304 may be disposed within or latch against other grooves, recesses, depressions, or other features along the outer surface 140 of the tool string 100.

The upper and lower frames 302, 304 may be coupled or fastened together about the tool string 100 via a coupling means, which may comprise bolts (not shown) engaging corresponding receptacles 316, 318 of the upper and lower frames 302, 304 to couple the upper and lower frames 302, 304. However, the upper and lower frames 302, 304 may be coupled together via other connection means, including fasteners, retaining pins, and press/interference fit, among other examples.

Figure 9:
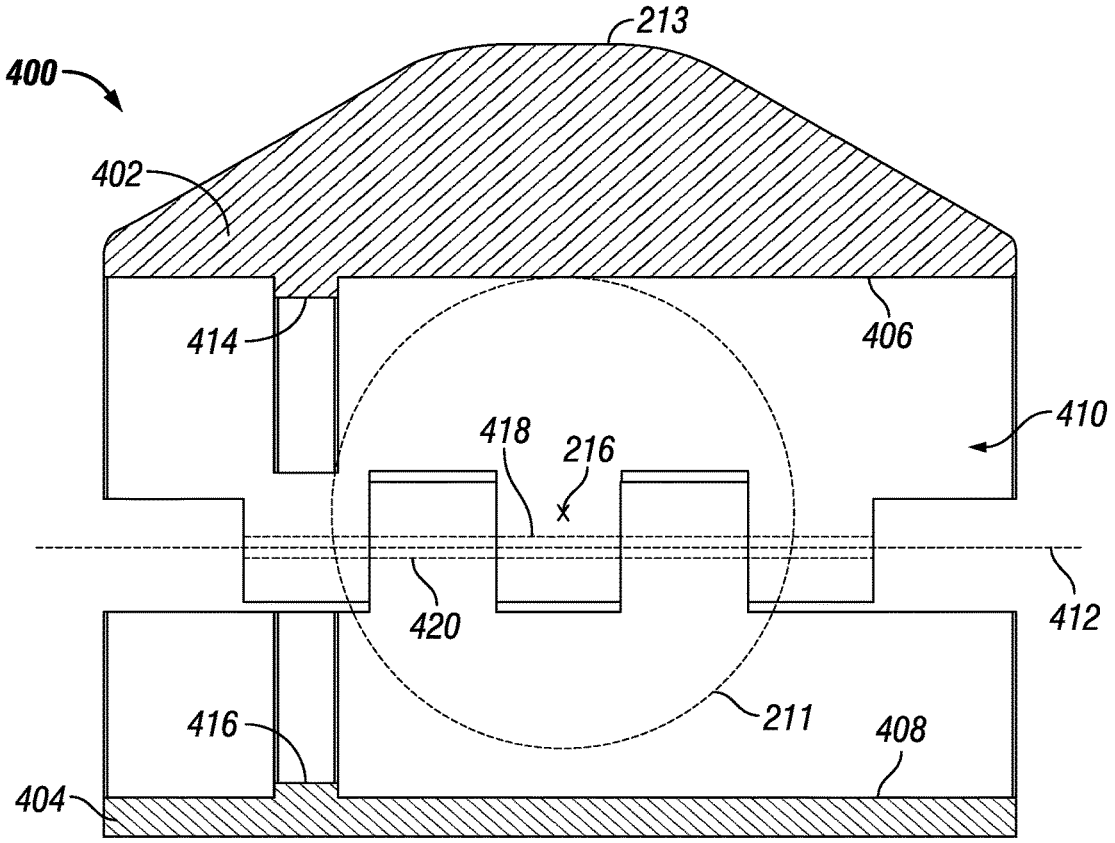
FIG. 9 is a sectional side view of a portion of another example implementation of the apparatus shown in FIG. 3 according to one or more aspects of the present disclosure.

FIG. 9 is a side sectional view of a portion of another example implementation of the orienting tool 200 shown in FIGS. 3-7 according to one or more aspects of the present disclosure, and designated in FIG. 9 by reference numeral 400. The orienting tool 400 is substantially similar in structure and operation to the orienting tool 200, including where indicated by like reference numbers, except as described below. The following description refers to FIGS. 5, 6, and 9, collectively.

The orienting tool 400 may comprise first, second, and third orienting features 211, 212, 213 connected with a frame assembly having an upper frame 402 and a lower frame 404. Each of the upper and lower frames 402, 404 may comprise a corresponding inner surface 406, 408 collectively defining a void 410 operable to receive at least a portion of the outer surface 140 of the tool string 100. The upper and lower frames 402, 404 may be disposed on opposing sides of the tool string 100 such that the opposing inner surfaces 406, 408 may collectively extend around the entire circumference of the tool string 100. The upper and lower frames 402, 404 may be disposed on opposing sides of the tool string 100, and may be connected together to clamp or otherwise hold onto the tool string 100. Such implementations may permit the tool string 100 to be captured or otherwise retained within the collective void 410, such as to maintain connection between the upper and lower frames 402, 404 and the tool string 100.

The collective void 410 may have a central axis 412 that substantially coincides with the central axis 101 of the tool string 100, and that is located below the axes of rotation 216, 218 of the first and second orienting features 211, 212. Accordingly, the center of gravity of the tool string 100 may be offset from the axes of rotation 216, 218 of the first and second orienting tools 211, 212 to urge the tool string 100 and the orienting tool 300 to rotate, as described herein. Furthermore, although the lower frame 404 may extend about the outer surface 140 of the tool string 100, the lower frame 404 may comprise a relatively thin wall with respect to the thickness of the combined upper frame 402 and third orienting feature 213. Such implementations may permit the outer surface 140 of the tool string 110 to be disposed in close proximity to the bottom portion of the sidewall 34.

The upper and lower frames 402, 404 may each comprise a corresponding lip or other protrusion 414, 416 extending radially inward from the respective surface 406, 408, such as may be at least partially inserted into the make-up groove 118 of the tool string 100. The upper and lower protrusions 414, 416 may permit the orienting tool 400 to grip the tool string 100 along the make-up groove 118, such as to reduce or prevent the orienting tool 400 from rotating about the tool string 100 and/or moving axially along the tool string 100. Although the upper and lower protrusions 414, 416 may be disposed within the make-up groove 118, the upper and lower protrusions 414, 416 may be disposed within or latch against other grooves, recesses, depressions, or other features along the outer surface 140 of the tool string 100.

The upper and lower frames 402, 404 may be coupled or fastened together about the tool string 100 via a coupling means, which may comprise bolts (not shown) engaging corresponding receptacles 416, 418 of the upper and lower frames 402, 404 to couple the upper and lower frames 402, 404. However, the upper and lower frames 302, 304 may be coupled together via other connection means, including fasteners, retaining pins, and press/interference fit, among other examples.

FIGS. 10-13 are axial views of a portion of an example implementation of the tool string 100 and an orienting tool 500 during different stages of operation. The orienting tool 500 is substantially similar in structure and operation to one or more of the orienting tools 200, 300, 400 shown in FIGS. 3-9, including where indicated by like reference numbers. FIGS. 10-13 show the orienting tool 500 connected with the tool string 100 and disposed within a non-vertical portion of the passage 31 defined by the side surface 35 having the radius 37. The following description refers to FIGS. 6 and 10-13, collectively.

Figure 10:
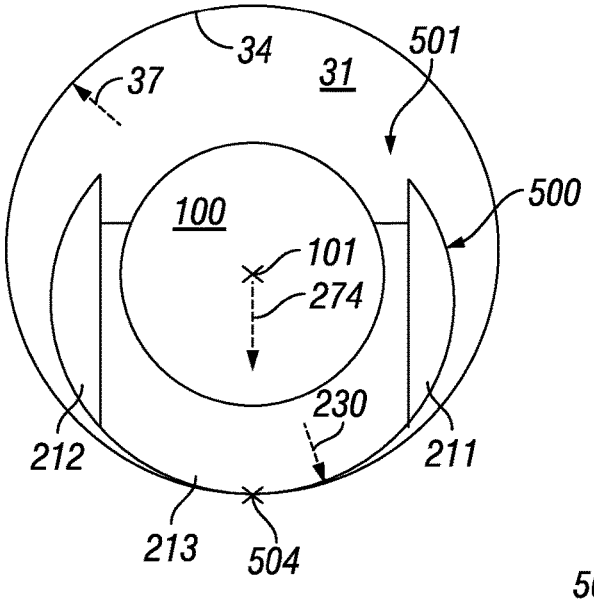
FIGS. 10-13 are schematic axial views of the apparatus shown in FIG. 3 during different stages of operation according to one or more aspects of the present disclosure.

FIG. 10 shows the orienting tool 500 disposed within the passage 31 in a fully inverted position, in which the third orienting feature 213 is extending in the downward direction and is in contact with the bottom portion of the sidewall 34 along a contact point 504. The weight of the tool string 100 is supported above the sidewall 34 by the orienting tool 100, and may be approximated by the downward force 274 applied along the center of gravity of the tool string 100, which may substantially coincide along the central axis 101 of the tool string 100. Although the center of gravity of the tool string 100 and, thus, the downward force 274, is shown located directly above the contact point 504, the orienting tool 500 and tool string 100 (collectively referred to hereinafter as a downhole assembly 501) may not be balanced or otherwise mechanically stable in such orientation. That is, the center of gravity of the tool string 100 is at a high position, causing the downhole system to be top heavy and, thus, not balanced or mechanically stable. Also, the radius 230 of the curved outer profile 232 of the third orienting feature 213 is smaller than the radius 37 of the sidewall 34 and, thus, unable to support or prop the downhole assembly 501 in such orientation. Accordingly, during conveying operations, if the downhole assembly 501 is introduced into or being conveyed along the passage 31 while in the orientation shown in FIG. 10, the third orienting feature 213 may urge rotation of the downhole assembly 501 away from the unstable orientation, in the direction of gravity and, thus, cause the downhole assembly 501 to rotate, such as toward an orientation shown in FIG. 11.

Figure 11:
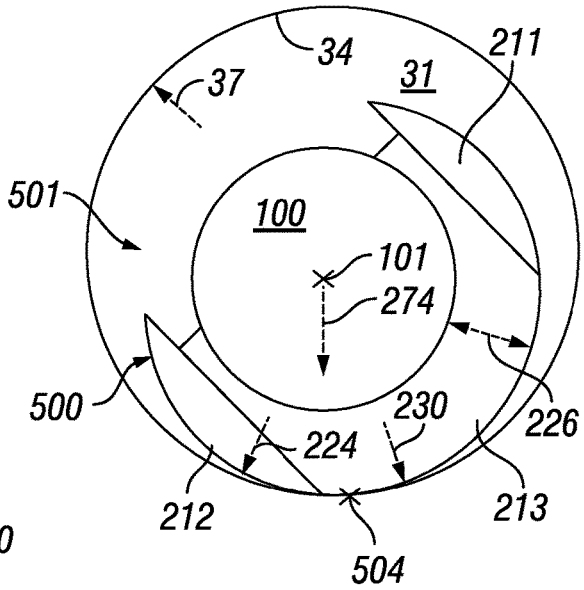

FIG. 11 shows the orienting tool 500 disposed within the passage 31 in a partially inverted position, in which the second and third orienting features 212, 213 are extending diagonally with respect to the downward direction such that one of the second and third orienting features are in contact with the bottom portion of the sidewall 34 along the contact point 504. The downhole assembly 501 may not be stable in such orientation, because the radii 224, 230 of the curved outer profiles 221, 232 of the second and third orienting features 212, 213 are smaller than the radius 37 of the sidewall 34 and, thus, unable to support or prop the downhole assembly 501 in such orientation. Also, the weight of the tool string 110, approximated by the downward force 274, may be horizontally offset from the contact point 504, thus urging further rotation of the downhole assembly 501. Rotation may also be urged by the progressively decreasing thickness 226 of the third orienting feature 213, as described above. Accordingly, during conveying operations, if the downhole assembly 501 is introduced into or being conveyed along the passage 31 while in the orientation shown in FIG. 11, the downhole assembly 501 will tend to further rotate toward the orientation shown in FIG. 12.

Figure 12:
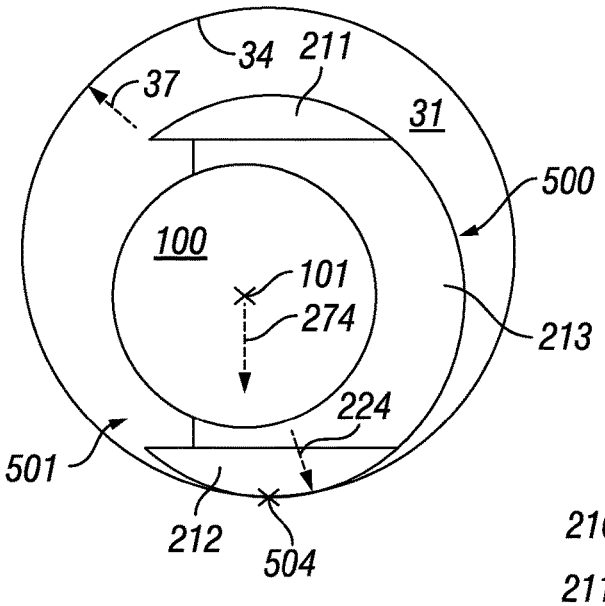

FIG. 12 shows the orienting tool 500 disposed within the passage 31 in a partially inverted position, in which the second orienting feature 212 is extending in the direction of gravity such that the second orienting feature 212 is in contact with the bottom portion of the sidewall 34 along the contact point 504. The downhole assembly 501 may not be stable in such orientation, because the radius 224 of the curved outer profile 221 of the second orienting feature 212 is smaller than the radius 37 of the sidewall 34 and, thus, unable to support or prop the downhole assembly 501 in such orientation. The weight of the tool string 110, approximated by the downward force 274, may still be horizontally offset from the contact point 504, thus urging further rotation of the downhole assembly 501. Accordingly, during conveying operations, if the downhole assembly 501 is introduced into or being conveyed along the passage 31 while in the orientation shown in FIG. 12, the downhole assembly 501 will tend to further rotate toward the orientation shown in FIG. 13.

Figure 13:
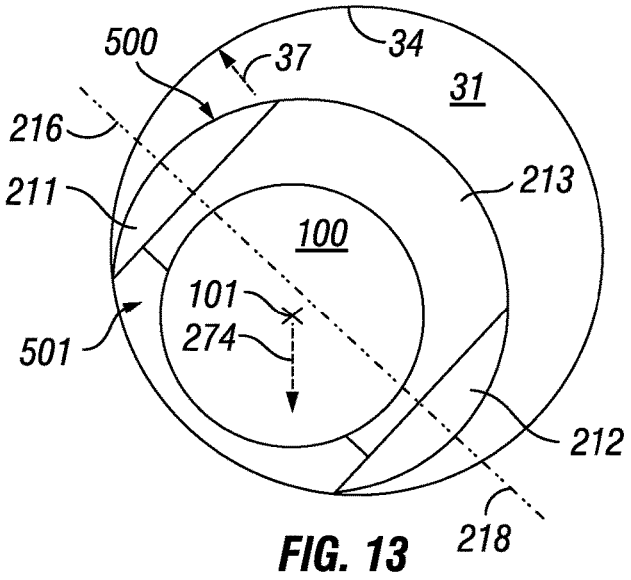

FIG. 13 shows the orienting tool 500 disposed within the passage 31 with the first and second orienting features 211, 212 in contact with the sidewall 34 of the passage 31. However the downhole assembly 501 is not in a stable orientation, because as the center of gravity of the tool string 100 is not at its closest distance from the bottom portion of the sidewall 34, and is located above the axis of rotation 218 of the second orienting feature 212. Accordingly, during conveying operations, if the downhole assembly 501 is introduced into or being conveyed along the passage 31 while in the orientation shown in FIG. 13, the weight of the tool string 110, approximated by the downward force 274, may urge further rotation of the downhole assembly 501 to its more stable orientation, in which the center of gravity and, thus, the central axis 101, is located below the axes of rotation 216, 218 of the orienting features 211, 212 and/or closest to the bottom portion of the sidewall 34, such as the orientation of the tool string 100 and the orienting tool 200 shown in FIG. 6.

Figure 14:
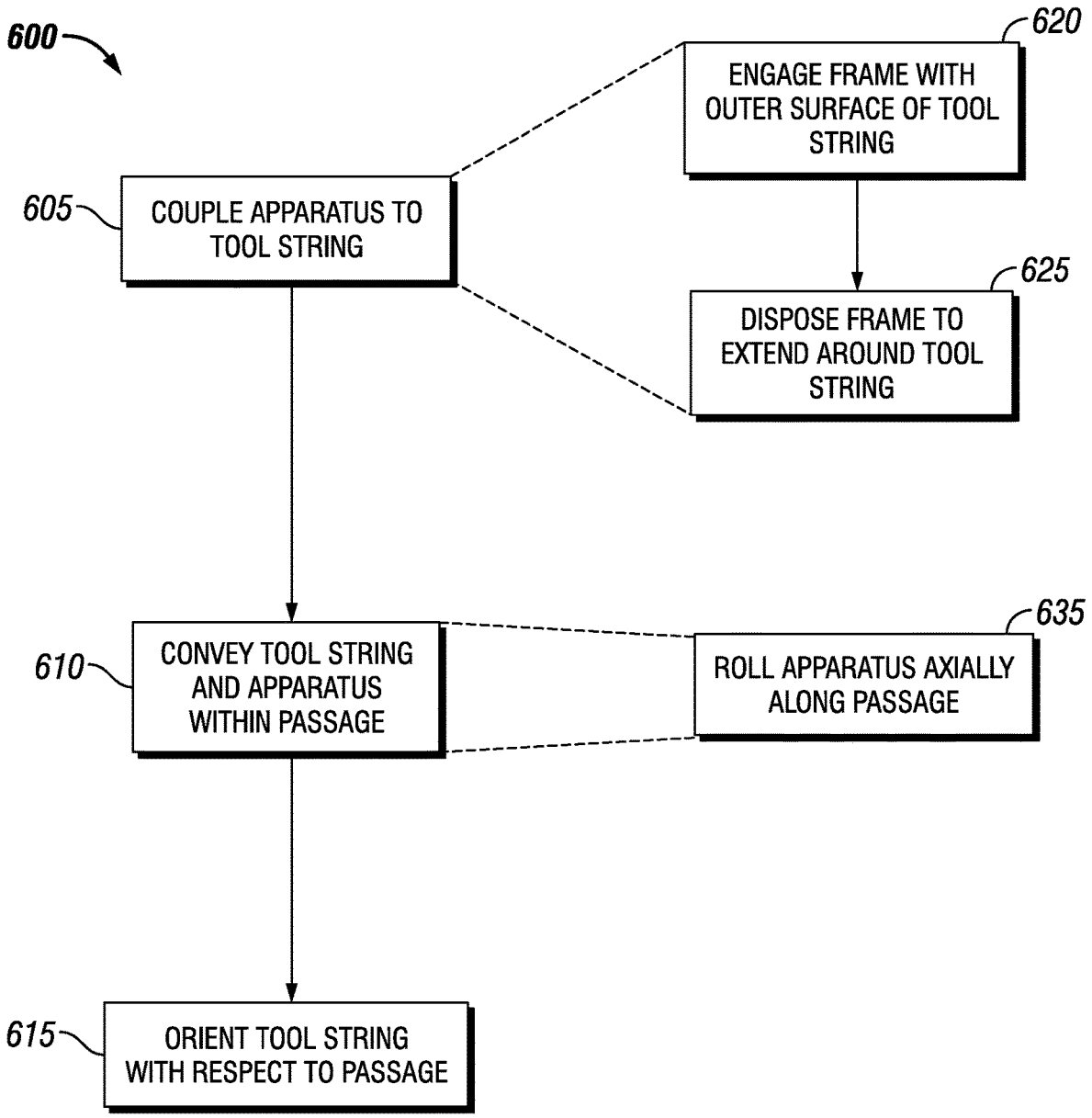
FIG. 14 is a flow-chart diagram of at least a portion of a method according to one or more aspects of the present disclosure.

FIG. 14 is a flow-chart diagram of at least a portion of an example implementation of a method (600) according to one or more aspects of the present disclosure. The method (600) may be performed utilizing or otherwise in conjunction with at least a portion of one or more implementations of one or more instances of the apparatus shown in one or more of FIGS. 3-13 and/or otherwise within the scope of the present disclosure. Thus, the following description of the method (600) also refers to apparatus shown in one or more of FIGS. 3-13. However, the method (600) may also be performed in conjunction with implementations of apparatus other than those depicted in FIGS. 3-13 that are also within the scope of the present disclosure.

The method (600) may comprise coupling (605) the apparatus 200 to a tool string 100, such that the first orienting feature 211 is rotatably connected on a first side of the tool string 100 to rotate around a first axis of rotation 216, and such that the second orienting feature 212 is rotatably connected on a second side of the tool string 100 opposite the first side to rotate around a second axis of rotation 218. As described above, the first and second axes of rotation 216, 218 are offset from the central axis 101 of the tool string 100, and may be substantially collinear. The method (600) also comprises conveying (610) the tool string 100 and the apparatus 200 within the passage 31 extending into the subterranean formation 30, and orienting (615) the tool string 100 with respect to the passage 31.

The apparatus may further comprise a frame 210 carrying the first and second orienting features 211, 212. Accordingly, the apparatus 200 may be coupled (605) with the tool string 100 by engaging (620) the frame 210 with an outer surface 140 of the tool string 100 in a manner preventing movement of the frame 210 relative to the tool string 100. Coupling (605) the apparatus 200 to the tool string 100 may include disposing (625) the frame 210 about the tool string 100 such that the frame 210 extends around at least a portion of a circumference of the tool string 100.

As described above, the first and second orienting features 211, 212 may comprise first and second rollers. Accordingly, conveying (610) the tool string 100 and the apparatus 200 within the passage 31 may comprise rolling (635) the apparatus 200 axially along a sidewall of the passage 31 to convey the tool string 100 within the passage 31, such that the first and second rollers of the first and second orienting features 211, 212 contact and roll along the sidewall of the passage 31.

Orienting (615) the tool string 100 may comprise and/or result in an urging of rotation of the apparatus 200 toward a mechanical stable orientation. As described above, the first, second, and third orienting features 211, 212, 213 may be utilized to cause such rotation. Consequently, the rollers of the first and second orienting features 211, 212 may contact the lower surface of the passage 31 and suspend the tool string 100 at an intended offset from the lower surface of the passage 31.

In view of the entirety of the present disclosure, a person having ordinary skill in the art will readily recognize that the present disclosure introduces an apparatus comprising a downhole tool operable for orienting a tool string within a passage, wherein the passage is a wellbore or a tubular member disposed in a wellbore, and wherein the downhole tool comprises: a frame operable for connection with the tool string; a first orienting feature connected to a first side of the frame, wherein the first orienting feature is rotatable relative to the frame about a first axis of rotation that is offset from a central axis of the tool string; and a second orienting feature connected to a second side of the frame, wherein the second orienting feature is rotatable relative to the frame about a second axis of rotation that is offset from the central axis of the tool string.

The first and second axes of rotation may be substantially collinear.

The first and second axes of rotation may extend substantially perpendicular to, but radially offset from, the central axis of the tool string.

The frame may be operable to engage an outer surface of the tool string in a manner preventing movement of the frame relative to the tool string.

The frame may extend around at least a portion of a circumference of the tool string. The frame may not extend around the entire circumference of the tool string. The frame may extend around a majority of the circumference of the tool string.

The frame may comprise an inner surface defining a void to receive an outer surface of the tool string.

The downhole tool may further comprise a third orienting feature having a center of mass that is offset from the central axis of the tool string in a radial direction. The first and second axes of rotation may be offset from the central axis of the tool string in the radial direction. The first and second axes of rotation may each interpose the center of mass of the third orienting feature and the central axis of the tool string. At least a portion of the third orienting feature may interpose the first and second orienting features. The third orienting feature may be integral to the frame. The third orienting feature may comprise a curved outer profile comprising a radius that is smaller than a radius of a sidewall of the passage. The third orienting feature may extend partially around a circumference of the tool string between the first and second orienting features. The first, second, and third orienting features may collectively form a substantially continuous curved outer profile extending at least partially around the circumference of the tool string. The substantially continuous curved outer profile may be substantially circular or substantially elliptical. The first and second orienting features may each extend radially outward from the tool string to a first distance. The third orienting feature may extend radially outward from the tool string to a second distance. The second distance may be substantially greater than the first distance.

The first and second orienting features may each comprise a roller operable to roll axially along the sidewall of the passage.

Each of the first and second orienting features may have a curved outer profile having a radius that may be smaller than a radius of a sidewall of the passage.

Each of the first and second orienting features may be rotatably connected with the frame via a corresponding axle and bushing. Each bushing may be disposed about the corresponding axle such that a frustoconical inner surface of the bushing may abut a frustoconical outer surface of the axle. Each bushing may further comprise a frustoconical outer surface abutting a corresponding frustoconical inner surface of the frame. Each axle may be fixedly coupled with a corresponding one of the first and second orienting features, and each bushing may be disposed between the corresponding axle and the frame. The bushings may be first bushings, and the downhole tool may further comprise second bushings each disposed about a corresponding axle and between the frame and a corresponding one of the first and second orienting features. Each of the second bushings may be disposed between a corresponding one of the first bushings and the corresponding one of the first and second orienting features.

The present disclosure also introduces an apparatus comprising: a downhole tool string adapted for conveyance within a passage extending into a subterranean formation, wherein the passage is a wellbore or a tubular member disposed in a wellbore; a first orienting feature and a second orienting feature each rotatably connected on opposing sides of the downhole tool string, wherein the first orienting feature comprises a first curved outer profile and the second orienting feature comprises a second curved outer profile; and a third orienting feature extending radially outward with respect to the tool string between the first and second orienting features, wherein: the third orienting feature comprises a third curved outer profile; the first, second, and third outer profiles collectively form a substantially continuous curved outer profile extending at least partially around the tool string; and the substantially continuous curved outer profile urges rotation of the apparatus within the passage in the direction of gravity.

The first orienting feature may be rotatable about a first axis of rotation, the second orienting feature may be rotatable about a second axis of rotation, and the first and second axes of rotation may be offset from a central axis of the tool string. The first and second axes of rotation may extend substantially perpendicular to the central axis of the tool string. The third orienting feature may comprise a center of mass that is offset from the central axis of the tool string in a radial direction, the first and second axes of rotation may be offset from the central axis of the tool string in the radial direction, and the first and second axes of rotation may each interpose the center of mass of the third orienting feature and the central axis of the tool string.

The third curved outer profile may comprise a radius that is smaller than a radius of a sidewall of the passage.

Each of the first and second curved outer profiles may comprise a radius that is smaller than a radius of a sidewall of the passage.

Each of the first, second, and third orienting features may extend partially around a circumference of the tool string.

The substantially continuous curved outer profile may be substantially circular or substantially elliptical.

The first and second orienting features may each extend radially outward from the tool string to a first distance, the third orienting feature may extend radially outward from the tool string to a second distance, and the second distance may be substantially greater than the first distance.

The first and second orienting features may each comprise a roller operable to roll axially along the sidewall of the passage.

The first, second, and third orienting features may be connected to a frame operable to engage an outer surface of the tool string in a manner preventing movement of the frame relative to the tool string. The third orienting feature may be integral to the frame. The frame may extend around at least a portion of a circumference of the tool string. The frame may not extend around the entire circumference of the tool string. The frame may extend around a majority of the circumference of the tool string. The frame may comprise an inner surface defining a void to receive an outer surface of the tool string. Each of the first and second orienting features may be rotatably connected with the frame via a corresponding axle and bushing. Each bushing may be disposed about the corresponding axle such that a frustoconical inner surface of the bushing abuts a frustoconical outer surface of the axle. Each bushing may further comprise a frustoconical outer surface abutting a corresponding frustoconical inner surface of the frame. Each axle may be fixedly coupled with a corresponding one of the first and second orienting features, and each bushing may be disposed between the corresponding axle and the frame. The bushings may be first bushings, and the downhole tool may further comprise second bushings each disposed about a corresponding axle and between the frame and a corresponding one of the first and second orienting features. Each of the second bushings may also be disposed between a corresponding one of the first bushings and the corresponding one of the first and second orienting features.

The present disclosure also introduces a method comprising: coupling an apparatus to a tool string such that first and second orienting features of the apparatus are disposed on respective first and second sides of the tool string and rotatable about respective first and second axes of rotation that are each offset from a central axis of the tool string; conveying the tool string and the apparatus within a passage extending into a subterranean formation; and orienting the tool string with respect to the passage.

The first and second axes of rotation may be substantially collinear.

The passage may be a wellbore or a tubular member disposed in a wellbore.

The apparatus may comprise a frame carrying the first and second orienting features, and coupling the apparatus to the tool string may comprise engaging the frame with an outer surface of the tool string in a manner preventing movement of the frame relative to the tool string. Coupling the apparatus to the tool string may further comprise disposing the frame about the tool string such that the frame extends around at least a portion of a circumference of the tool string.

The first and second orienting features may comprise first and second rollers, and conveying the tool string and the apparatus within the passage may comprise rolling the apparatus axially along the passage to convey the tool string within the passage as the first and second rollers roll along an inner surface of the passage.

Orienting the tool string may comprise urging rotation of the apparatus in the direction of gravity to cause the tool string to rotate.

The apparatus may further comprise a third orienting feature having a center of mass that is offset from the central axis of the tool string and extends radially outward from the tool string, and orienting the tool string may comprise urging rotation of the apparatus in the direction of gravity to cause the tool string to rotate.

The apparatus may further comprise a third orienting feature extending radially outward from the tool string between the first and second orienting features. The third orienting feature may have a curved outer profile extending partially around a circumference of the tool string. The curved outer profile may comprise a radius that is smaller than a radius of a sidewall of the passage. Orienting the tool string may further comprise rotating the apparatus within the passage in the direction of gravity. The first and second orienting features may extend radially outward with respect to the tool string, and may have a curved outer profile extending partially around the circumference of the tool string. The curved outer profile of each of the first and second orienting features may comprise a radius that is smaller than the radius of the sidewall of the passage. The first, second, and third orienting features may collectively form a substantially continuous curved outer profile extending at least partially around the circumference of the tool string. Orienting the tool string may further comprise rotating the apparatus along the sidewall of the passage in the direction of gravity.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. A downhole tool operable to connect to a tool string and reduce friction between the tool string and a sidewall of a wellbore through which the tool string is conveyed, wherein the downhole tool comprises:

a frame operable to connect to the tool string;

a first wheel connected to the frame;

a second wheel connected to the frame; and a hump disposed at least partially between the first wheel and the second wheel, wherein the hump comprises a plurality of holes extending therethrough between opposing sides of the hump, and wherein, when the downhole tool is connected to the tool string:

the first wheel, the second wheel, and the hump collectively define a curved outer profile extending circumferentially around at least a portion of a circumference of the tool string;

the curved outer profile has a geometric center that is offset from a central axis of the tool string; and the weight of the tool string and the offset between the geometric center and the central axis cause a torque that urges rotation of the connected downhole tool and tool string within the wellbore toward a position in which the central axis is below the geometric center.

2. The downhole tool of claim 1 wherein:

the first wheel defines a first curved outer profile portion;

the second wheel defines a second curved outer profile portion;

the hump defines a third curved outer profile portion;

the first curved outer profile portion, the second curved outer profile portion, and the third curved outer profile portion collectively form the curved outer profile; and the third curved outer profile portion comprises a radius that is smaller than a radius of the wellbore through which the tool string is conveyed.

3. The downhole tool of claim 1 wherein, when the downhole tool is connected to the tool string:

the hump defines a portion of the curved outer profile extending circumferentially around a portion of the circumference of the tool string at a radial distance from the tool string; and the radial distance progressively decreases from a center of the hump to opposing ends of the hump.

4. The downhole tool of claim 1 wherein, when the downhole tool is connected to the tool string:

the curved outer profile extends circumferentially around the at least a portion of the circumference of the tool string at a radial distance from the tool string; and the radial distance progressively decreases from a center of the hump to a lower end of each of the first wheel and the second wheel.

5. A downhole tool operable to connect to a tool string and reduce friction between the tool string and a sidewall of a wellbore through which the tool string is conveyed, wherein the downhole tool comprises:

a first wheel comprising a first curved outer profile;

a second wheel comprising a second curved outer profile; and a hump comprising a third curved outer profile, wherein the hump is disposed at least partially between the first wheel and the second wheel, wherein the hump comprises a plurality of holes extending therethrough between opposing sides of the hump, wherein the first curved outer profile, the second curved outer profile, and the third curved outer profile collectively define a collective curved outer profile, and wherein, when the downhole tool is connected to the tool string:

the collective curved outer profile extends circumferentially around at least a portion of a circumference of the tool string; and the collective curved outer profile has a geometric center that is offset from a central axis of the tool string.

6. The apparatus of claim 5 wherein, when the downhole tool is connected to the tool string, the weight of the tool string and the offset between the geometric center and the central axis cause a torque that urges rotation of the connected downhole tool and tool string within the wellbore toward a position in which the central axis is below the geometric center.

7. The downhole tool of claim 5 wherein the third curved outer profile extends continuously from the first curved outer profile to the second curved outer profile.

8. The downhole tool of claim 5 wherein the third curved outer profile comprises a radius that is smaller than a radius of the wellbore through which the tool string is conveyed.

9. The downhole tool of claim 5 wherein, when the downhole tool is connected to the tool string:

the collective curved outer profile extends circumferentially around the at least a portion of the circumference of the tool string at a radial distance from the tool string; and the radial distance progressively decreases from a center of the hump to a lower end of each of the first wheel and the second wheel.

10. A method comprising:

connecting a downhole tool comprising a first wheel, a second wheel, and a hump to a tool string such that the first wheel, the second wheel, and the hump each extend away from the tool string and collectively define a curved outer profile that extends circumferentially around at least a portion of a circumference of the tool string and has a geometric center that is offset from a central axis of the tool string, wherein the hump comprises a plurality of holes extending therethrough between opposing sides of the hump; and conveying the connected downhole tool and tool string within a wellbore while:

the downhole tool reduces friction between the tool string and a sidewall of the wellbore; and the weight of the tool string and the offset between the geometric center and the central axis causes a torque that urges rotation of the connected downhole tool and tool string within the wellbore toward a position in which the central axis is below the geometric center.

11. The method of claim 10 wherein, when the downhole tool is connected to the tool string:

the hump defines a portion of the curved outer profile extending circumferentially around a portion of the circumference of the tool string at a radial distance from the tool string; and the radial distance progressively decreases from a center of the hump to opposing ends of the hump.

12. A downhole tool operable to connect to a tool string and reduce friction between the tool string and a sidewall of a wellbore through which the tool string is conveyed, wherein the downhole tool comprises:

a frame operable to connect to the tool string;

a first wheel connected to the frame, wherein the first wheel defines a first curved outer profile portion;

a second wheel connected to the frame, wherein the second wheel defines a second curved outer profile portion; and a hump disposed at least partially between the first wheel and the second wheel, wherein the hump defines a third curved outer profile portion, wherein the third curved outer profile portion defines a smooth transition between the first curved outer profile portion and the second curved outer profile portion, and wherein, when the downhole tool is connected to the tool string:

the first wheel, the second wheel, and the hump collectively define a curved outer profile extending circumferentially around at least a portion of a circumference of the tool string;

the first curved outer profile portion, the second curved outer profile portion, and the third curved outer profile portion collectively form the curved outer profile;

the curved outer profile has a geometric center that is offset from a central axis of the tool string; and the weight of the tool string and the offset between the geometric center and the central axis cause a torque that urges rotation of the connected downhole tool and tool string within the wellbore toward a position in which the central axis is below the geometric center.

13. A downhole tool operable to connect to a tool string and reduce friction between the tool string and a sidewall of a wellbore through which the tool string is conveyed, wherein the downhole tool comprises:

a frame operable to connect to the tool string;

a first wheel connected to the frame;

a second wheel connected to the frame; and a hump disposed at least partially between the first wheel and the second wheel, wherein, when the downhole tool is connected to the tool string:

the first wheel, the second wheel, and the hump collectively define a curved outer profile extending circumferentially around at least a portion of a circumference of the tool string;

the first wheel defines a first curved outer profile portion extending circumferentially around a first portion of the circumference of the tool string;

the second wheel defines a second curved outer profile portion extending circumferentially around a second portion of the circumference of the tool string;

the hump defines a third curved outer profile portion extending circumferentially around a third portion of the circumference of the tool string; and the first curved outer profile portion, the second curved outer profile portion, and the third curved outer profile portion collectively form the curved outer profile;

the curved outer profile has a geometric center that is offset from a central axis of the tool string; and the weight of the tool string and the offset between the geometric center and the central axis cause a torque that urges rotation of the connected downhole tool and tool string within the wellbore toward a position in which the central axis is below the geometric center.

14. The apparatus of claim 13 wherein the third curved outer profile extends continuously from the first curved outer profile to the second curved outer profile.

15. A downhole tool operable to connect to a tool string and reduce friction between the tool string and a sidewall of a wellbore through which the tool string is conveyed, wherein the downhole tool comprises:

a first wheel comprising a first curved outer profile;

a second wheel comprising a second curved outer profile; and a hump comprising a third curved outer profile, wherein the hump is disposed at least partially between the first wheel and the second wheel, wherein the third curved outer profile defines a smooth transition between the first curved outer profile and the second curved outer profile, wherein the first curved outer profile, the second curved outer profile, and the third curved outer profile collectively define a collective curved outer profile, and wherein, when the downhole tool is connected to the tool string:

the collective curved outer profile extends circumferentially around at least a portion of a circumference of the tool string; and the collective curved outer profile has a geometric center that is offset from a central axis of the tool string.

16. A downhole tool operable to connect to a tool string and reduce friction between the tool string and a sidewall of a wellbore through which the tool string is conveyed, wherein the downhole tool comprises:

a first wheel comprising a first curved outer profile;

a second wheel comprising a second curved outer profile; and a hump comprising a third curved outer profile, wherein the hump is disposed at least partially between the first wheel and the second wheel, wherein the third curved outer profile extends continuously from the first curved outer profile to the second curved outer profile, wherein the first curved outer profile, the second curved outer profile, and the third curved outer profile collectively define a collective curved outer profile, and wherein, when the downhole tool is connected to the tool string:

the collective curved outer profile extends circumferentially around at least a portion of a circumference of the tool string; and the collective curved outer profile has a geometric center that is offset from a central axis of the tool string.

17. A downhole tool operable to connect to a tool string and reduce friction between the tool string and a sidewall of a wellbore through which the tool string is conveyed, wherein the downhole tool comprises:

a first wheel comprising a first curved outer profile;

a second wheel comprising a second curved outer profile; and a hump comprising a third curved outer profile, wherein the hump is disposed at least partially between the first wheel and the second wheel, wherein the first curved outer profile, the second curved outer profile, and the third curved outer profile collectively define a collective curved outer profile, and wherein, when the downhole tool is connected to the tool string:

the third curved outer profile extends circumferentially around a portion of the circumference of the tool string at a radial distance from the tool string;

the radial distance progressively decreases from a center of the hump to opposing ends of the hump;

the collective curved outer profile extends circumferentially around at least a portion of a circumference of the tool string; and the collective curved outer profile has a geometric center that is offset from a central axis of the tool string.

18. A downhole tool operable to connect to a tool string and reduce friction between the tool string and a sidewall of a wellbore through which the tool string is conveyed, wherein the downhole tool comprises:

a first wheel comprising a first curved outer profile;

a second wheel comprising a second curved outer profile; and a hump comprising a third curved outer profile, wherein the hump is disposed at least partially between the first wheel and the second wheel, wherein the first curved outer profile, the second curved outer profile, and the third curved outer profile collectively define a collective curved outer profile, and wherein, when the downhole tool is connected to the tool string:

the collective curved outer profile extends circumferentially around at least a portion of a circumference of the tool string;

the first curved outer profile extends circumferentially around a first portion of the circumference of the tool string;

the second curved outer profile extends circumferentially around a second portion of the circumference of the tool string;

the third curved outer profile extends circumferentially around a third portion of the circumference of the tool string; and the collective curved outer profile has a geometric center that is offset from a central axis of the tool string.

19. The apparatus of claim 18 wherein the third curved outer profile extends continuously from the first curved outer profile to the second curved outer profile.

20. A method comprising:

connecting a downhole tool comprising a first wheel, a second wheel, and a hump to a tool string such that the first wheel, the second wheel, and the hump each extend away from the tool string and collectively define a curved outer profile that extends circumferentially around at least a portion of a circumference of the tool string and has a geometric center that is offset from a central axis of the tool string, wherein:

the first wheel defines a first curved outer profile portion;

the second wheel defines a second curved outer profile portion;

the hump defines a third curved outer profile portion;

the first curved outer profile portion, the second curved outer profile portion, and the third curved outer profile portion collectively form the curved outer profile; and third curved outer profile extends continuously from the first curved outer profile to the second curved outer profile; and conveying the connected downhole tool and tool string within a wellbore while:

the downhole tool reduces friction between the tool string and a sidewall of the wellbore; and the weight of the tool string and the offset between the geometric center and the central axis causes a torque that urges rotation of the connected downhole tool and tool string within the wellbore toward a position in which the central axis is below the geometric center.

* * * * *